US011287203B2

(12) United States Patent
Thomele et al.

(10) Patent No.: US 11,287,203 B2
(45) **Date of Patent: *Mar. 29, 2022**

(54) AMMUNITION MAGAZINE

(71) Applicant: Sig Sauer, Inc., Newington, NH (US)

(72) Inventors: Adrian Thomele, Stratham, NH (US); Jason Knight, Exeter, NH (US); Scott D. Shinkle, Greenland, NH (US)

(73) Assignee: Sig Sauer, Inc., Newington, NH (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/070,224

(22) Filed: Oct. 14, 2020

(65) Prior Publication Data

US 2021/0041197 A1 Feb. 11, 2021

Related U.S. Application Data

(63) Continuation of application No. 16/661,197, filed on Oct. 23, 2019, now Pat. No. 10,962,315, which is a continuation of application No. 16/230,028, filed on Dec. 21, 2018, now Pat. No. 10,480,880.

(60) Provisional application No. 62/609,965, filed on Dec. 22, 2017.

(51) Int. Cl.

| | |
|---|---|
| ***F41A 9/69*** | (2006.01) |
| ***F41A 9/70*** | (2006.01) |
| ***F41A 9/65*** | (2006.01) |

(52) U.S. Cl.

CPC ..... *F41A 9/70* (2013.01); *F41A 9/65* (2013.01); *F41A 9/69* (2013.01)

(58) Field of Classification Search

CPC ..... F41A 9/69; F41A 9/65; F41A 9/70; F41A 9/72

USPC ..... 42/50, 49.01

See application file for complete search history.

(56) References Cited

U.S. PATENT DOCUMENTS

| | | | |
|---|---|---|---|
| 1,245,499 | A | 11/1917 | Orme |
| 1,833,862 | A | 11/1931 | Hugo |
| 2,396,816 | A | 3/1946 | Boudreau |
| 3,399,480 | A | 9/1968 | Rowe, Jr. |

(Continued)

FOREIGN PATENT DOCUMENTS

| | | | |
|---|---|---|---|
| CN | 2938003 | Y | 8/2007 |
| EP | 2336705 | A1 | 6/2011 |

OTHER PUBLICATIONS

Aim Surplus, Used Sig Sauer P320/P250 Full Size .45 Auto 10rd Magazine, available at https://aimsurplus.com/used-sig-sauer-p320-p250-full-size-45-auto-10rd-magazine/#gallery (last visited Jan. 11, 2021).

(Continued)

*Primary Examiner* — Reginald S Tillman, Jr.
(74) *Attorney, Agent, or Firm* — Finch & Maloney PLLC

(57) ABSTRACT

A detachable box magazine for firearms includes a hollow magazine tube extending longitudinally along a median plane. The magazine tube defines a single-stack portion extending substantially to an upper tube end that defines an upper tube opening. The magazine tube has a double-stack portion positioned below the single-stack portion and extending to a bottom tube end. For example, front portions of the opposite tube sidewalls have a stepped shape between the upper tube end and the double-stack portion, and the rear portions of the sidewalls have a linear taper between the upper tube end and the double-stack portion.

20 Claims, 11 Drawing Sheets

(56) References Cited

U.S. PATENT DOCUMENTS

| | | | |
|---|---|---|---|
| D241,837 | S | 10/1976 | Sofinowski |
| 4,495,720 | A | 1/1985 | Bross |
| 4,502,237 | A | 3/1985 | Krogh |
| 4,589,218 | A | 5/1986 | Teppa |
| 4,862,619 | A | 9/1989 | Baldus et al. |
| 4,888,899 | A | 12/1989 | Chesnut et al. |
| D309,768 | S | 8/1990 | Blackshaw |
| 5,099,595 | A | 3/1992 | Chestnut |
| 5,309,660 | A | 5/1994 | Blackamore |
| 5,357,703 | A | 10/1994 | Chestnut |
| 5,438,783 | A | 8/1995 | Sniezak |
| D362,044 | S | 9/1995 | Sniezak |
| 5,461,811 | A | 10/1995 | Ciener |
| 5,666,752 | A | 9/1997 | Grams |
| 5,906,065 | A | 5/1999 | Pearce |
| 6,401,379 | B1 | 6/2002 | Moon |
| 6,568,115 | B2 | 5/2003 | Beretta |
| D487,790 | S | 3/2004 | Freed |
| D487,791 | S | 3/2004 | Freed |
| D493,861 | S | 8/2004 | Rauch et al. |
| 7,117,622 | B2 | 10/2006 | Freed et al. |
| D598,065 | S | 8/2009 | Vukovic et al. |
| D614,720 | S | 4/2010 | Fitzpatrick et al. |
| D614,721 | S | 4/2010 | Fitzpatrick et al. |
| D616,057 | S | 5/2010 | Fitzpatrick et al. |
| D620,544 | S | 7/2010 | Fitzpatrick et al. |
| D620,545 | S | 7/2010 | Fitzpatrick et al. |
| D632,752 | S | 2/2011 | Fitzpatrick et al. |
| D633,164 | S | 2/2011 | Fitzpatrick et al. |
| D633,589 | S | 3/2011 | Fitzpatrick et al. |
| D633,590 | S | 3/2011 | Fitzpatrick et al. |
| D642,234 | S | 7/2011 | Marfione |
| D645,112 | S | 9/2011 | Sullivan et al. |
| D654,978 | S | 2/2012 | Karanian et al. |
| D670,350 | S | 11/2012 | Emde |
| D670,784 | S | 11/2012 | Emde |
| 8,365,454 | B2 | 2/2013 | Hogan, Jr. |
| 8,371,058 | B2 | 2/2013 | Trpcic |
| D680,613 | S | 4/2013 | Fitzpatrick et al. |
| D681,131 | S | 4/2013 | Su |
| D681,151 | S | 4/2013 | Fitzpatrick et al. |
| 8,448,364 | B2 | 5/2013 | Davidson |
| D688,766 | S | 8/2013 | Fitzpatrick et al. |
| D688,767 | S | 8/2013 | Bennett et al. |
| D690,374 | S | 9/2013 | Lee |
| D691,233 | S | 10/2013 | Bennett et al. |
| D692,513 | S | 10/2013 | Yigit |
| 8,561,334 | B2 | 10/2013 | Metzger |
| D695,378 | S | 12/2013 | Fitzpatrick et al. |
| D704,790 | S | 5/2014 | Mayberry et al. |
| D705,886 | S | 5/2014 | Kielsmeier et al. |
| 8,713,835 | B1 | 5/2014 | Calvert |
| D707,783 | S | 6/2014 | Kielsmeier et al. |
| 8,752,318 | B2 | 6/2014 | Pulit, Jr. |
| D710,479 | S | 8/2014 | Nakayama et al. |
| D726,279 | S | 4/2015 | Stedman |
| D727,456 | S | 4/2015 | Schefter et al. |
| 9,021,730 | B2 | 5/2015 | Gentilini et al. |
| D735,831 | S | 8/2015 | Faifer |
| D744,049 | S | 11/2015 | Chu |
| D745,944 | S | 12/2015 | Kielsmeier et al. |
| D746,403 | S | 12/2015 | Kielsmeier et al. |
| D748,219 | S | 1/2016 | Kielsmeier |
| D754,802 | S | 4/2016 | Martelli et al. |
| 9,303,936 | B2 | 4/2016 | Toner |
| D755,324 | S | 5/2016 | Martelli et al. |
| D755,907 | S | 5/2016 | Hu |
| D757,884 | S | 5/2016 | Kielsmeier |
| D758,519 | S | 6/2016 | Toner et al. |
| 9,383,142 | B2 | 7/2016 | Nakayama et al. |
| 9,395,129 | B2 | 7/2016 | Ball |
| 9,441,897 | B2 | 9/2016 | Mather |
| 9,546,831 | B2 | 1/2017 | Bandini et al. |
| 9,551,550 | B2 | 1/2017 | Wells |
| D783,111 | S | 4/2017 | Hillis |
| 9,664,471 | B1 | 5/2017 | Curry et al. |
| D791,262 | S | 7/2017 | Brown et al. |
| D798,983 | S | 10/2017 | Chen |
| D799,631 | S | 10/2017 | Chen |
| D803,341 | S | 11/2017 | Wolf |
| D808,487 | S | 1/2018 | Beville et al. |
| D810,223 | S | 2/2018 | Kielsmeier |
| D812,176 | S | 3/2018 | Kielsmeier |
| D814,593 | S | 4/2018 | O'Clair et al. |
| D814,596 | S | 4/2018 | Curry |
| D815,233 | S | 4/2018 | Toner et al. |
| 9,945,627 | B2 | 4/2018 | Porat |
| D823,969 | S | 7/2018 | Beville et al. |
| D828,881 | S | 9/2018 | Lee |
| D828,892 | S | 9/2018 | Kellgren |
| D829,894 | S | 10/2018 | Hwang et al. |
| D830,480 | S | 10/2018 | Chu |
| 10,088,269 | B2 | 10/2018 | Sheets, Jr. et al. |
| D834,130 | S | 11/2018 | Schefter |
| D834,656 | S | 11/2018 | Chu |
| D838,333 | S | 1/2019 | Kielsmeier |
| D839,376 | S | 1/2019 | Hefer et al. |
| 10,180,298 | B2 | 1/2019 | Noonan |
| D845,424 | S | 4/2019 | Hefer et al. |
| 10,281,226 | B2 | 5/2019 | Liptak et al. |
| D858,680 | S | 9/2019 | Thomele et al. |
| D859,571 | S | 9/2019 | Spine |
| D860,336 | S | 9/2019 | Gong |
| 10,480,880 | B2 * | 11/2019 | Thomele ..... F41A 9/69 |
| D868,925 | S | 12/2019 | Novak et al. |
| D877,265 | S | 3/2020 | Hu |
| D883,416 | S | 5/2020 | Muller |
| D889,587 | S | 7/2020 | Wallgren |
| D892,253 | S | 8/2020 | Kielsmeier |
| D898,852 | S | 10/2020 | Kielsmeier |
| 10,962,315 | B2 * | 3/2021 | Thomele ..... F41A 9/70 |
| 2001/0037596 | A1 | 11/2001 | Salvitti |
| 2002/0029506 | A1 | 3/2002 | Wollmann |
| 2004/0031181 | A1 | 2/2004 | Freed |
| 2005/0011097 | A1 | 1/2005 | Freed et al. |
| 2008/0028661 | A1 | 2/2008 | Bubits |
| 2010/0251590 | A1 | 10/2010 | Fitzpatrick et al. |
| 2012/0066950 | A1 | 3/2012 | Davidson |
| 2013/0180146 | A1 | 7/2013 | Fitzpatrick et al. |
| 2013/0227870 | A1 | 9/2013 | Rendulic |
| 2014/0373416 | A1 | 12/2014 | Barnart |
| 2015/0121736 | A1 | 5/2015 | Faifer |
| 2015/0192377 | A1 | 7/2015 | Larson, Jr. |
| 2015/0241162 | A1 | 8/2015 | Geraghty et al. |
| 2015/0276339 | A1 | 10/2015 | Shreve |
| 2016/0025436 | A1 | 1/2016 | Higley |
| 2017/0146309 | A1 | 5/2017 | Biran |
| 2017/0146310 | A1 | 5/2017 | Biran |
| 2017/0184359 | A1 | 6/2017 | Porat |
| 2017/0191771 | A1 | 7/2017 | Zimmer |
| 2018/0058785 | A1 | 3/2018 | Hefer et al. |
| 2018/0066907 | A1 | 3/2018 | Hefer et al. |
| 2018/0347929 | A1 | 12/2018 | Hsu et al. |
| 2019/0195584 | A1 | 6/2019 | Thomele et al. |
| 2020/0056852 | A1 | 2/2020 | Thomele et al. |

OTHER PUBLICATIONS

Midwest Gun Works, Sig Sauer P250 / P320 Compact .45 ACP 9 Round Magazine, available at https://www.midwestgunworks.com/page/mgwi/prod/MAG-MOD-C-45-9 (last visited Jan. 11, 2021).

Sig Sauer, P250/P320 Compact 9rd .45 ACP Magazine, available at https://www.sigsauer.com/p250-p320-compact-9rd-45acp-magazine.html (last visited Jan. 11, 2021).

P228, P229 10rd 9mm Magazine, SigSauer.com, https://www.sigsauer.com/store/p228-p229-10rd-9mm-magazine.html>, (2019).

P229 10rd .40 Auto, .357Sig Magazine, SigSauer.com, https://www.sigsauer.com/store/p229-10rd-40-auto-357sig-magazine.html> (2019).

Ruger American Pistol Magazine 10 Round 9mm Luger Mag (90514), GoOutdoorGear.com, https://www.gooutdoorgear.com/ruger-american-pistol-magazine-10-round-9mm-luger-mag-90514/736676905140/> (2019).

(56) References Cited

OTHER PUBLICATIONS

Beretta APX Magazine 9mm 21 Rds Unpackaged, BerettaUSA.com, https://www.berettausa.com/en/us/apx-9mm-mag-21-rds-bulk/jmapx219bulk/> (2019).
Ruger American Pistol Pro Model Parts List, pp. 34-37 (2016).
Comments and Photos Received from Competitor's Counsel Regarding the SIG P229-40 Cal. Magazine (Mar. 17, 2020).
International Search Report and Written Opinion, PCT Application No. US2018/67191 (dated Mar. 22, 2019).
International Preliminary Report on Patentability, PCT/US18/67191 (dated Mar. 22, 2019).
"Instruction Manual for Ruger American Pistol Pro Model", Sturm, Ruger & Co., Inc. (2016).
"Instruction Manual for Ruger American Pistol, Standard Model", Sturm, Ruger & Co., Inc. (2016).
"P365, Everyday Carry Size with Unprecedented 10+1 Full Size Capacity", https://www.sigsauer.com/products/firearms/pistols/p365/ (Jan. 10, 2018).
Sig Sauer, 2016 Product Catalog, https://www.sigsauer.com/wp-content/uploads/2016/01/2016-SIG-SAUER-CATALOG.pdf (2016).
Heckler & Koch, HK WebShop Website, HK-P30/VP9 10rd Magazine, SKU# 229750S, https://us.hkwebshop.com/hkstorefront/hk/en/Handgun-Parts/Magazines/P30-VP9-10rd-Magazine/p/229750S (accessed May 1, 2020).
Heckler & Koch, HK-P30SK Handgun, https://hk-usa.com/hk-models/p30sk/ (accessed May 1, 2020).
Heckler & Koch, HK-P30SK-Operators-Manual, Heckler & Koch (May 2015).
BOTACH.com, HK-USP 45 ACP Magazine, https://botach.com/hk-usp-45-acp-12rd-w-base-magazines/(accessed May 1, 2020).
GunMagWarehouse.com, HK-USP-9 9 mm 15-Round Polymer Magazine, https://gunmagwarehouse.com/hk-usp-9-9mm-15-round-polymer-magazine.html (accessed May 1, 2020).
McNett, John C., counsel for competitor, email to L. Carrol (Apr. 29, 2020).
Sig Sauer, Sig Pro Magazine for SP2009, SP2022, 9mm Luger Steel Matte, (accessed May 1, 2020).
Sig Sauer, P250 Handling & Safety Instructions, OM-P250-USA Ver. (Jul. 7, 2001).
Sig Sauer, P224 Magazine, 9mm Luger Steel Matte, https://www.midwayusa.com/product/2139442581 (accessed May 1, 2020).
PrimaryArms.com, Sig Sauer P250/320 Compact Magazine 9 mm—15 Round Handgun, available at https://www.primaryarms.com/sig-p250-320-compact-magazine-9mm-15-round (accessed May 1, 2020).
Sig Sauer, P320 Handgun and M17 Magazine 9 mm—15 Round (accessed May 1, 2020).
Sig Sauer, P224 9mm Magazine Drawing Sheet (Sep. 7, 2012) (Redacted).
Sig Sauer, P224 .40 Cal. Magazine Drawing Sheet (Mar. 6, 2012) (Redacted).
Sig Sauer, P320 9mm Magazine Drawing Sheet (Jun. 19, 2019) (Redacted).
Sig Sauer, P320 .40 Cal. Magazine Drawing Sheet (Jun. 18, 2019) (Redacted).
Sig Sauer, SP2022 9mm Magazine Drawing Sheet Rev. 02 (Oct. 26, 2017) (Redacted).
Sig Sauer, Observations on Certain Sig Sauer Magazines (May 2020).
"Pre-'94 Ban Factory Sig Sauer P229 German 12rd 40 s&w magazine," https://www.gunpartssupply.com/pre-94- ban-factory-sig-sauer-p229-german-12rd-40-s-w-magazine.html) (1994).
The Sig Sauer P229, http://www.sadefensejournal.com/wp/the-sig-sauer-p229/ (2014).
European Patent Office, Supplementary European Search Report, EP Patent Application No. 18890487.4 (dated Aug. 13, 2021).

* cited by examiner

AMMUNITION MAGAZINE

RELATED APPLICATIONS

This application claims priority under 35 U.S.C. § 120 as a continuation of U.S. patent application Ser. No. 16/661,197, filed on Oct. 23, 2019, and titled AMMUNITION MAGAZINE, which is a continuation of U.S. patent application Ser. No. 16/230,028, filed on Dec. 21, 2018, and titled AMMUNITION MAGAZINE, which claims priority under 35 U.S.C. § 119(e) to U.S. provisional patent application No. 62/609,965, filed on Dec. 22, 2017, and titled AMMUNITION MAGAZINE, the contents of which applications are incorporated herein by reference in their entireties.

FIELD OF THE DISCLOSURE

This disclosure relates to accessories and components for use with projectile weapons and more particularly to a detachable box magazine for small arms ammunition.

BACKGROUND

Firearms design involves many non-trivial challenges. Traditionally, semiautomatic handguns have been made with a metal frame that includes the grip. The grip portion defines a magazine well into which a magazine is installed. A slide mounts to and slides longitudinally along rails along the top of the frame as the action is cycled. The frame defines an open region adjacent and above the magazine well for the fire control group. Components of the fire control group are installed in the frame, often with a pin that extends laterally through the frame. More recently, the traditional semiautomatic pistol has been modified to include a polymer grip module that defines a well for a separate metal frame that houses the fire control group. The frame is installed into the grip module above the magazine well and includes rails for the slide. Some such handguns have become popular for their reduced weight and modularity.

SUMMARY

One aspect of the present disclosure is directed to a detachable box magazine for use with a handgun, rifle, or other firearm. Another further aspect of the present disclosure is directed to a handgun or a handgun grip module in combination with a magazine, in accordance with embodiments of the present disclosure.

Figure 1:
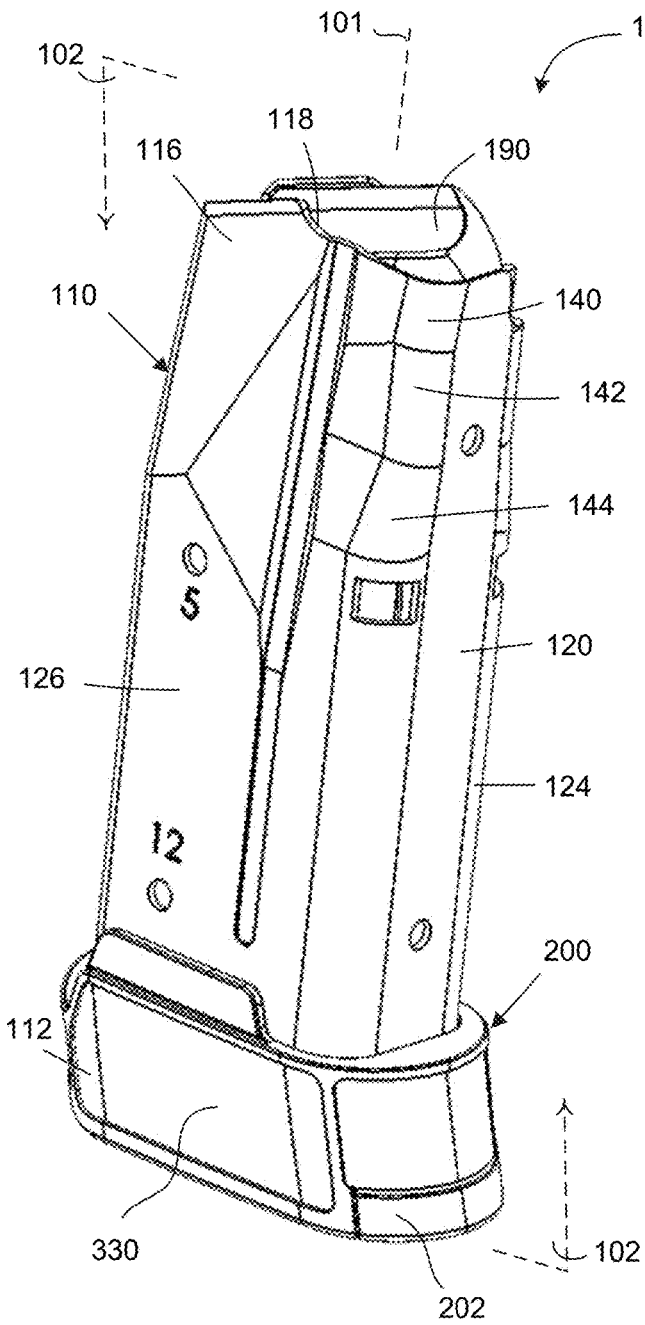
FIG. 1 illustrates a right, front perspective view of a pistol magazine in accordance with an embodiment of the present disclosure.

These and other features of the present embodiments will be better understood by reading the following detailed description, taken together with the Figures herein described. For purposes of clarity, not every component may be labeled in every drawing. Furthermore, as will be appreciated, the figures are not necessarily drawn to scale or intended to limit the present disclosure to the specific configurations shown. In short, the Figures are provided merely to show example structures.

DETAILED DESCRIPTION

With the introduction of handguns with polymer grip modules in recent years, much interest has developed in smaller, lighter handguns. Polymer grip modules have enabled handguns to be lighter in weight, even for full-size handguns. Additionally, handgun manufacturers have realized an increased interest in compact and subcompact semiautomatic handguns. For example, "carry" pistols, or handguns designed to be small and easy to conceal, have attracted the attention of many gun buyers due to their small size. However, handgun design presents many non-trivial challenges, especially with the combined goals of making an attractive handgun that exhibits good ergonomics, accurate shooting, a reliable fire control assembly, adequate ammunition capacity, the desired or required safety mechanisms, and a reasonable price to the consumer.

For carry pistols, added challenges include providing a compact size and shape for ease of concealment without undue sacrifices to ammunition capacity. To make a carry pistol less prone to imprint its shape on garments concealing it, the handgun and its components can include softened edges and fewer angular surfaces. However, the overall size and thickness of the handgun remains the primary challenge to concealment and comfort while carrying. Reducing the size of a handgun generally means a shorter barrel, a shorter grip, a reduced thickness, or a combination of these traits. As a general matter, each reduction in size has a corresponding tradeoff, such as increased felt recoil, increased muzzle flip, reduced accuracy, reduced ammunition capacity, and a change in the firearm's controls.

Depending on the intended use, ammunition capacity can be an important factor when selecting a handgun. Semiautomatic handguns use a box magazine that is received in the magazine well extending into the gun's grip. Box magazines for semiautomatic handguns traditionally have been available in two main configurations, namely, single stack and double stack. In single-stack magazines, all cartridges are aligned in a single column with each cartridge arranged on top of the cartridge below it. Single-stack box magazines enable the grip of some handguns to have a lateral thickness of about one inch (~2.5 cm), sometimes slightly less, depending on chambering and the particular grips installed on the frame. A single-stack magazine is often found in handguns with a smaller thickness. Since the size of ammunition cartridges is fixed for a given caliber, the minimum size and thickness of a handgun grip is determined by the dimensions of a single stack of ammunition and the magazine used to contain it. For this reason, many carry pistols are configured for use with single-stack magazines due to the reduced lateral thickness of these magazines. For example, full-sized 1911-style handguns generally have a single-stack box magazine with a capacity of nine rounds of 9 mm ammunition, resulting in a grip thickness from about 1.1 to about 1.3 inches (2.8 to 3.3 cm). Compact handguns, carry pistols, and "pocket" pistols chambered in 9 mm and 0.380 ACP also feature single-stack box magazines often holding six to eight rounds with a grip thickness of about one inch (~2.5 cm).

One factor relevant to grip size and concealability is the lateral thickness or width of the handgun, particularly as measured at the grip. Despite the potential advantages of a narrower grip, some shooters prefer semiautomatic handguns equipped with double-stack box magazines due to the increased ammunition capacity. For example, full-sized handguns often accommodate magazines that hold fifteen, seventeen, or even twenty rounds. Reducing the size of the handgun usually means a sacrifice in ammunition capacity. More compact handguns often have a reduced grip length that accommodates only the middle and ring fingers, and therefore accommodates a shorter magazine as well. Double-stack magazines for these compact handguns may hold ten to twelve rounds of 9 mm ammunition, for example. In either case, handguns configured for a double-stack magazine typically have an overall thickness of about 1.5 inches (3.8 cm).

A thicker grip or frame that is configured for use with traditional double-stack magazines can result in a handgun being perceived as bulky, less comfortable to carry, and more difficult to conceal. A grip's lateral thickness depends in part on the size of the magazine well and in part on the thickness of the grip and the structural material defining the magazine well.

Grip thickness is a feature that also affects the user's control over the handgun when firing. A handgun grip that can be grasped firmly by the user generally provides better control and shooting accuracy to the user. Ergonomic principles suggest that the grip should be small enough to enable a "power grip" in which the user's fingers wrap firmly around the grip and can be overlapped by the thumb with the fingertips spaced slightly (e.g., ~1 cm) from the palm. In the power grip, the forearm muscles are contracted about halfway through the range of contraction and therefore are at the most efficient stage of contraction. This muscular efficiency provides more strength and enables the user to exert better control over the pistol, such as in response to recoil forces.

In addition to the thickness and overall size of the grip, the grip's shape can be important. To prevent sliding or rotation of the handgun within the user's hand, the grip can be ergonomically shaped with a non-cylindrical shape, a non-uniform diameter, and/or a thickened central portion. Including one or more of these features can increase the user's control of the handgun during firing by enabling the user to more securely grip the handgun and therefore to prevent movement of the handgun in the user's hand(s).

Buyers choosing a handgun have been faced with the dilemma of selecting a handgun with the combination of overall size, grip thickness, ammunition capacity, and many other features best suited to the user's needs. In order to have a handgun with a reduced grip thickness, buyers have sacrificed the greater ammunition capacity of a double-stack magazine in favor of handguns configured for use with the slimmer single-stack magazines. Thus, a need exists for a handgun with a reduced grip thickness for improved concealability and control, but having increased ammunition capacity compared to single-stack designs. Accordingly, the present disclosure relates to an ammunition magazine for a firearm, particularly semiautomatic pistols.

General Overview

A magazine in accordance with embodiments of the present disclosure provides a double-stack portion and a single-stack portion, enabling the handgun to have a reduced overall thickness and a reduced grip thickness, but while retaining a higher ammunition capacity compared to single-stack magazines.

In accordance with some embodiments, a magazine includes a magazine tube with a double-stack portion configured to contain ammunition in an offset, stacked configuration. Above the double-stack portion is a single-stack portion in which ammunition can be arranged with the projectile of each cartridge generally aligned one above the other when the magazine is upright. For example, the single-stack portion of the magazine contains two, three, or more cartridges with projectiles generally aligned in a vertical stack.

In accordance with some embodiments of the present disclosure, an ammunition magazine has a spring plate that is received in a recess defined in a floorplate that can be attached to and close a lower end of the magazine tube. In accordance with yet other embodiments of the present disclosure, a magazine includes a grip extension retained on the magazine tube by the floor plate. For example, the floorplate can be installed between the magazine tube and the grip extension on the lower end of the magazine tube, where the floorplate maintains the position of the grip extension on the magazine tube.

The present disclosure is also directed to a handgun configured for a magazine with single-stack and double-stack portions. Some embodiments of ammunition magazines according to the present disclosure advantageously enable the corresponding handgun to have an increased ammunition capacity while maintaining a reduced grip thickness along at least part of the grip. In some embodiments, the grip is narrower adjacent the user's index finger and thumb and has a region of greater thickness below. In one such embodiment, the thickness is increased in regions that extend down along the user's palm. Such features can result in improved ergonomics. Also, by utilizing features that reduce the vertical size of the magazine's components, ammunition magazines of the present disclosure advantageously provide increased ammunition capacity compared to traditional single-stack magazines while at the same time enabling a reduced grip thickness compared to pistols configured for traditional double-stack magazines. Numerous configurations and variations will be apparent in light of this disclosure.

As will be appreciated in light of the present disclosure, and in accordance with some embodiments, ammunition magazines configured as described herein are not limited for use with semiautomatic handguns, but can be utilized with any of a wide range of firearms that includes a pistol, a rifle, short-barreled rifle, machine gun, and shotgun. In accordance with some example embodiments, a magazine configured as described herein can be utilized with a semiautomatic handgun chambered in .380 Auto, 9 mm Luger, .357 SIG, 10 mm Auto, .40 S&W, .45 ACP ammunition, or other suitable ammunition. Other suitable host firearms and ammunition will be apparent in light of this disclosure.

In accordance with some embodiments, the disclosed apparatus may be detected, for example, by visual inspection of a firearm magazine having one or more features selected from a single-stack portion and a double-stack portion, a spring plate that partially recesses into the floorplate of the magazine tube, and a grip extension that is retained on the magazine tube by a floorplate.

Structure and Operation

Example embodiments of the present disclosure are illustrated in FIGS. 1-23. As discussed herein, terms referencing direction, such as upward, downward, vertical, horizontal, left, right, front, back, etc., are used for convenience to describe embodiments of a magazine in an upright orientation. Embodiments according to the present disclosure are not limited by these directional references and it is contemplated that magazines of the present disclosure could be used in any orientation.

It should also be noted that certain terminology is used herein for consistency and ease of understanding the present disclosure; however, the present disclosure is not limited to that specific terminology and alternate terms can be used to refer to the magazine and its components. For example, the disclosed magazine can alternately be referred to as a box magazine, an ammunition magazine, or other terms. Similarly, the disclosed floorplate can alternately be referred to, for example, as a bottom plate, a butt plate, a base plate, a magazine bottom, or other terms. Similarly, the disclosed spring plate can alternately be referred to as a magazine insert, a floorplate insert, a spring floorplate, a spring base plate, a floorplate lock, a magazine bottom holder, a magazine base lock, or other terms. As will be further appreciated, the particular configuration (e.g., materials, dimensions, etc.) of a magazine and its components configured as described herein may be varied, for example, depending on whether the intended use is military, law enforcement, civilian, tactical, or recreational in nature. Numerous configurations will be apparent in light of this disclosure.

Figure 2:
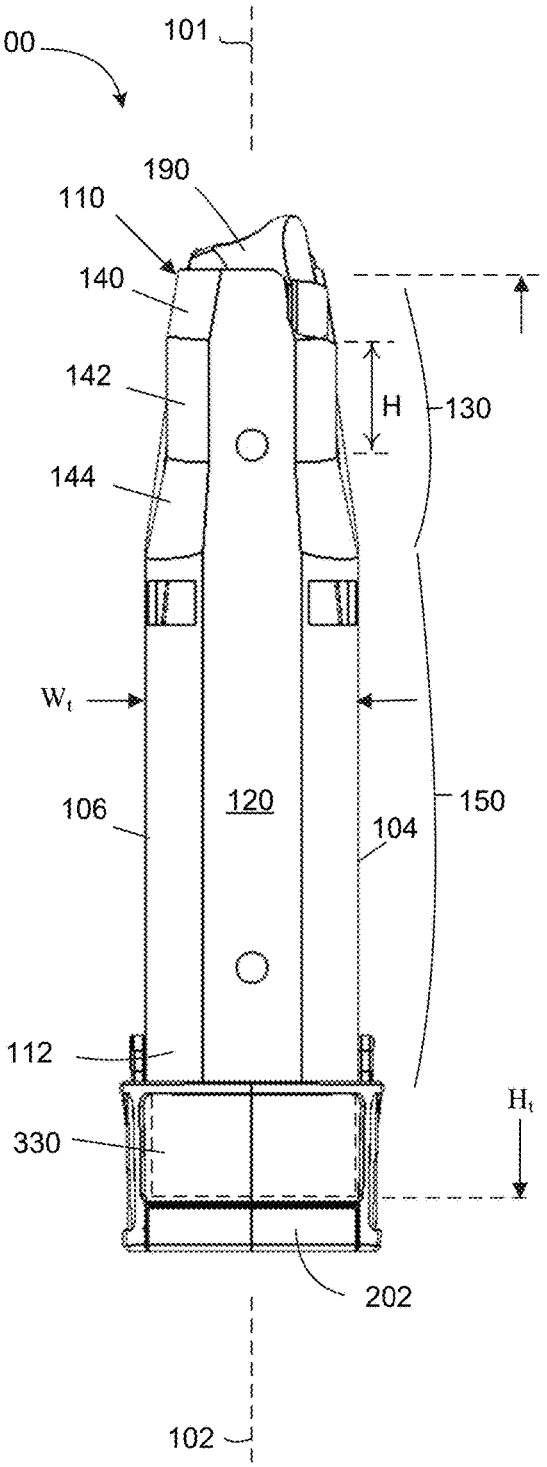
FIG. 2 illustrates a front elevational view of the pistol magazine of FIG. 1, showing the stepped profile of the distal or front margin of the single-stack portion.
Figure 3:
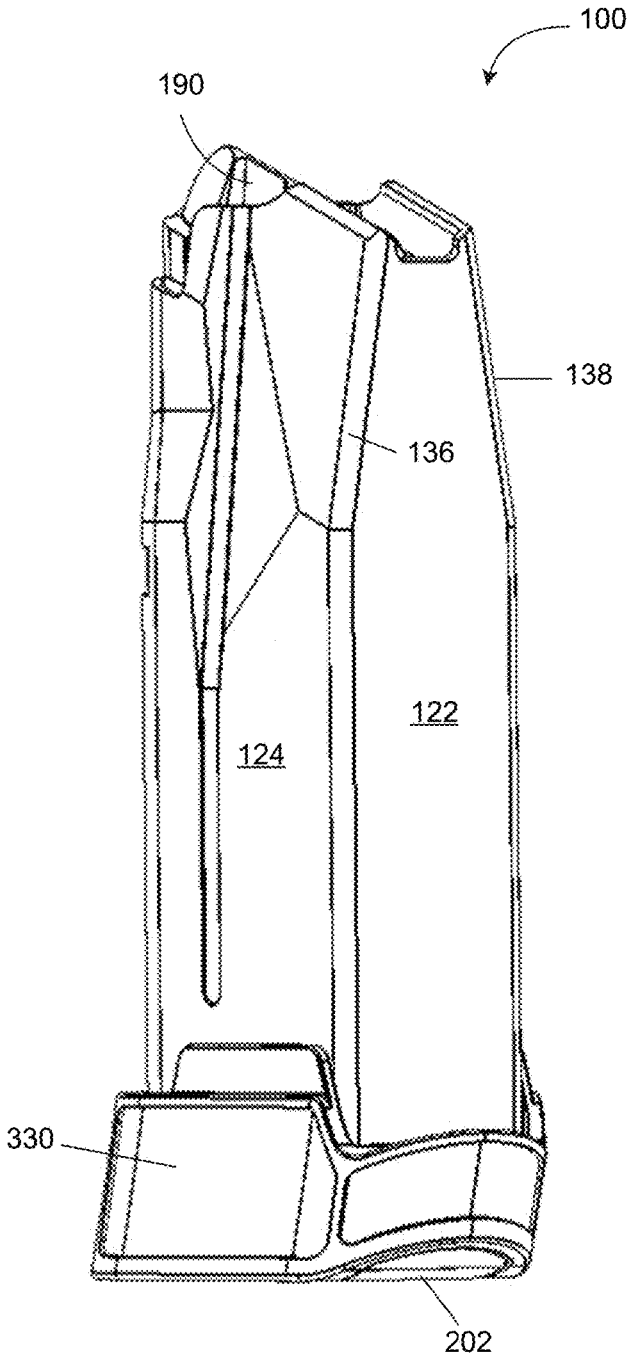
FIG. 3 illustrates a left-side and rear perspective view of the pistol magazine of FIG. 1.
Figure 4:
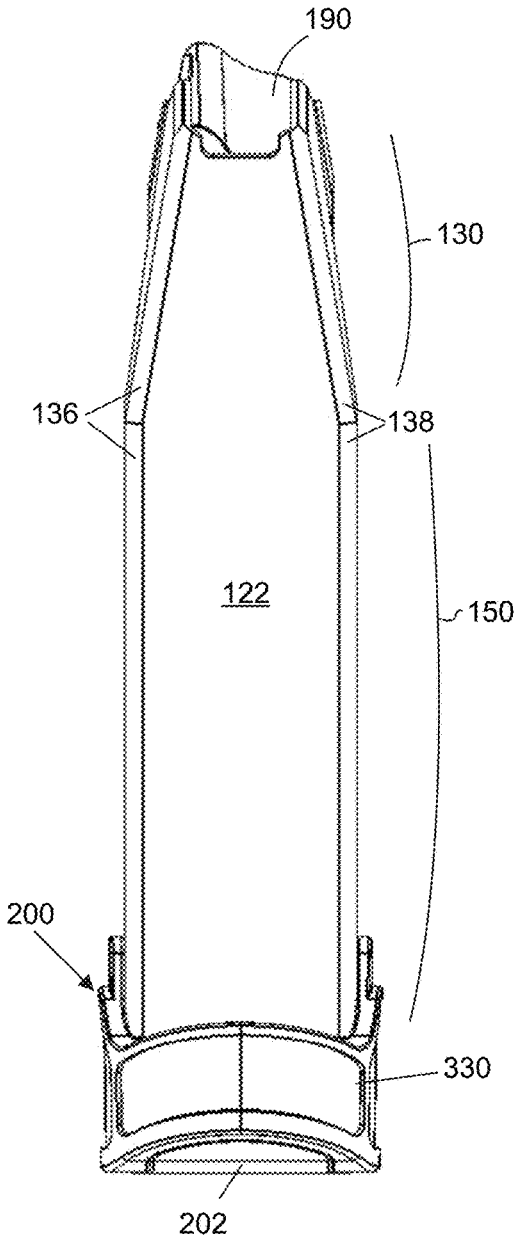
FIG. 4 illustrates a rear elevational view of the pistol magazine of FIG. 1, showing the straight tapered profile of the proximal or rear margin of the single-stack portion.
Figure 5:
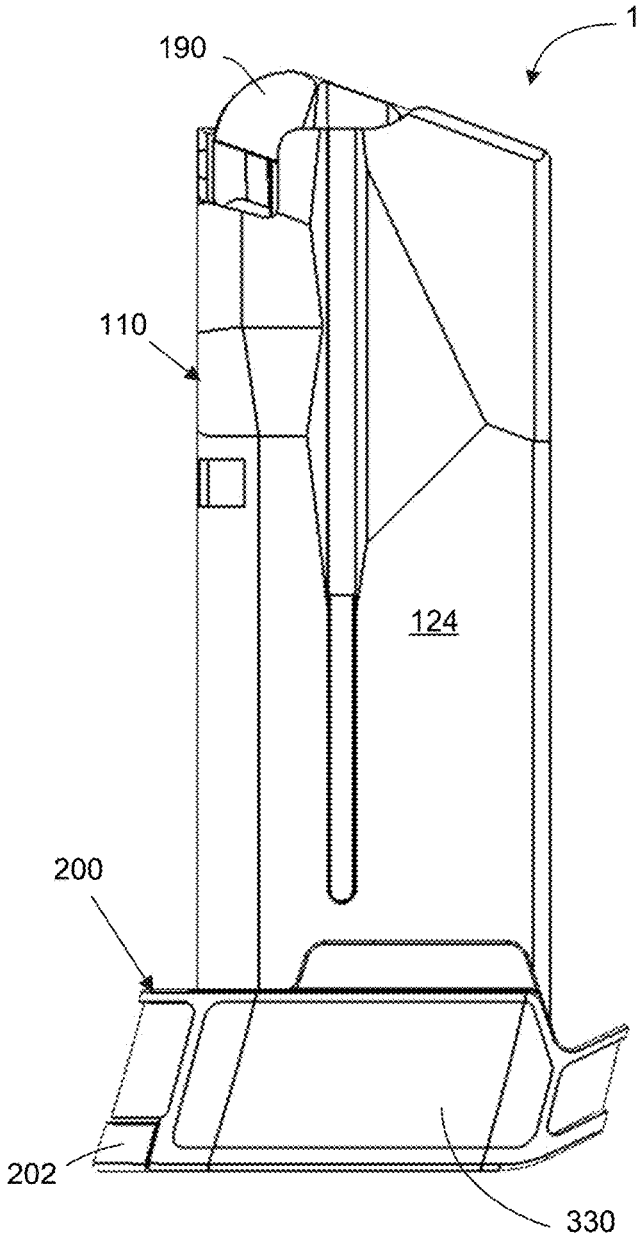
FIG. 5 illustrates a left-side elevational view of the pistol magazine of FIG. 1.
Figure 6:
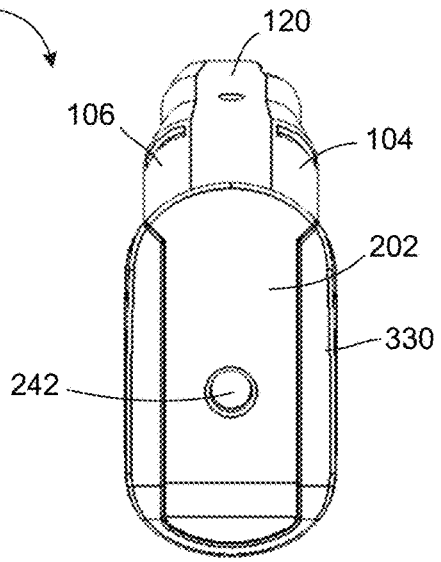
FIG. 6 illustrates a bottom and front perspective view of the pistol magazine of FIG. 1.
Figure 7:
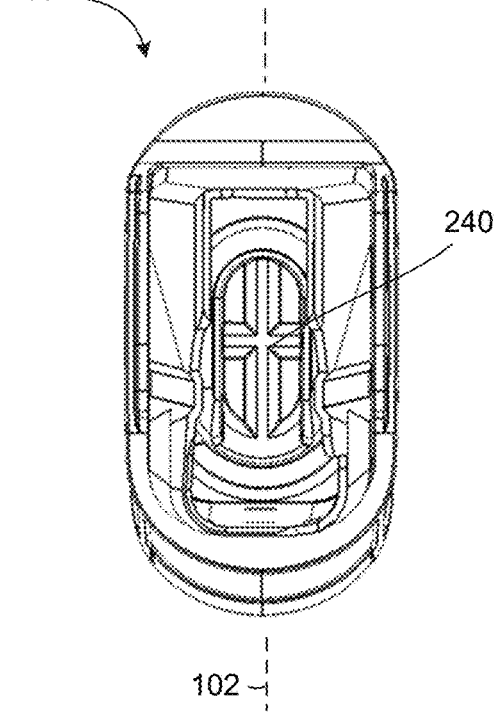
FIG. 7 illustrates a top view of the pistol magazine of FIG. 1 as viewed looking axially into the magazine tube towards the spring plate.
Figure 8:
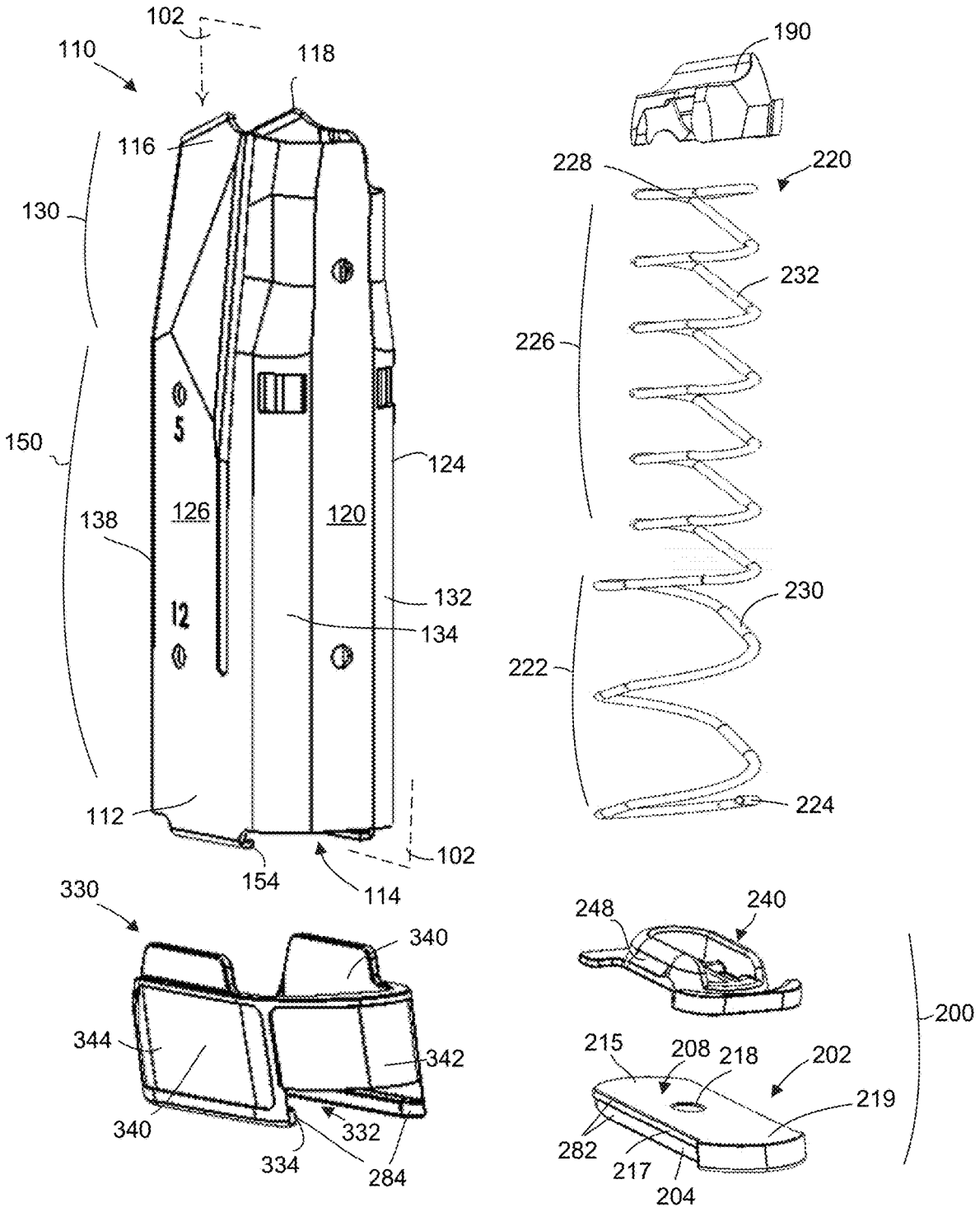
FIG. 8 illustrates an exploded, perspective view of the pistol magazine of FIG. 1 showing components of the magazine in accordance with an embodiment of the present disclosure.

FIG. 1 illustrates a right and front perspective view of one embodiment of a pistol magazine 100 with a magazine tube 110 having a single-stack portion 130 and a double-stack portion 150. Magazine 100 of FIG. 1 is shown with one embodiment of a floorplate assembly 200 that includes a grip extension 330 with a floorplate 202 that retains grip extension 330 on magazine tube 110. FIG. 2 illustrates a front elevational view of pistol magazine 100 of FIG. 1, showing a stepped profile of front lateral margins 132, 134 along single-stack portion 130 of magazine tube 110; FIG. 3 illustrates a left-side and rear perspective view of pistol magazine 100; FIG. 4 illustrates a rear elevational view of pistol magazine 100, showing the straight tapered profile of rear lateral margins 136, 138 along single-stack portion 130; FIG. 5 illustrates a left-side elevational view of pistol magazine 100; FIG. 6 illustrates a bottom and front perspective view of pistol magazine 100; FIG. 7 illustrates a top view of pistol magazine 100 as viewed looking axially into a magazine tube 110 towards a spring plate 240; and FIG. 8 illustrates an exploded, perspective view of pistol magazine 100 showing its components in accordance with an embodiment of the present disclosure. Not all features are shown in all figures.

Figure 20:
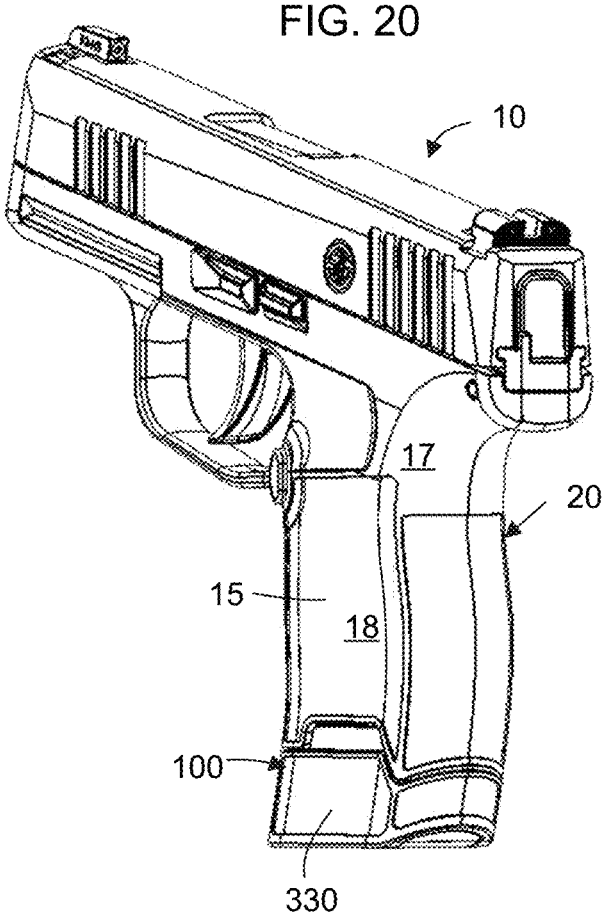
FIG. 20 illustrates a rear, left-side, and top perspective view of a handgun with pistol magazine with grip extension installed in the magazine well in accordance with an embodiment of the present disclosure.
Figure 21:
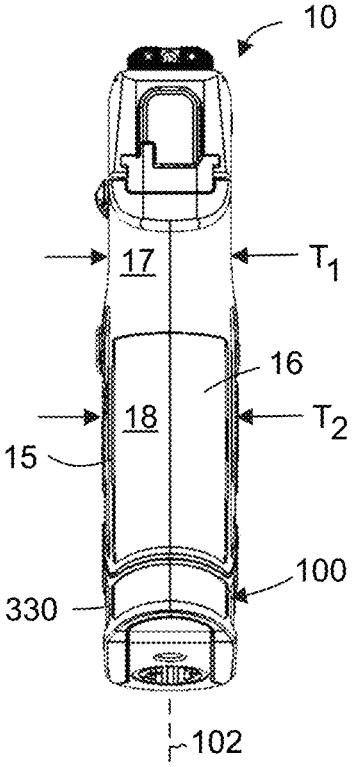
FIG. 21 illustrates a rear elevational view of the handgun of FIG. 20 showing the profile of various grip portions in accordance with an embodiment of the present disclosure.
Figure 22:
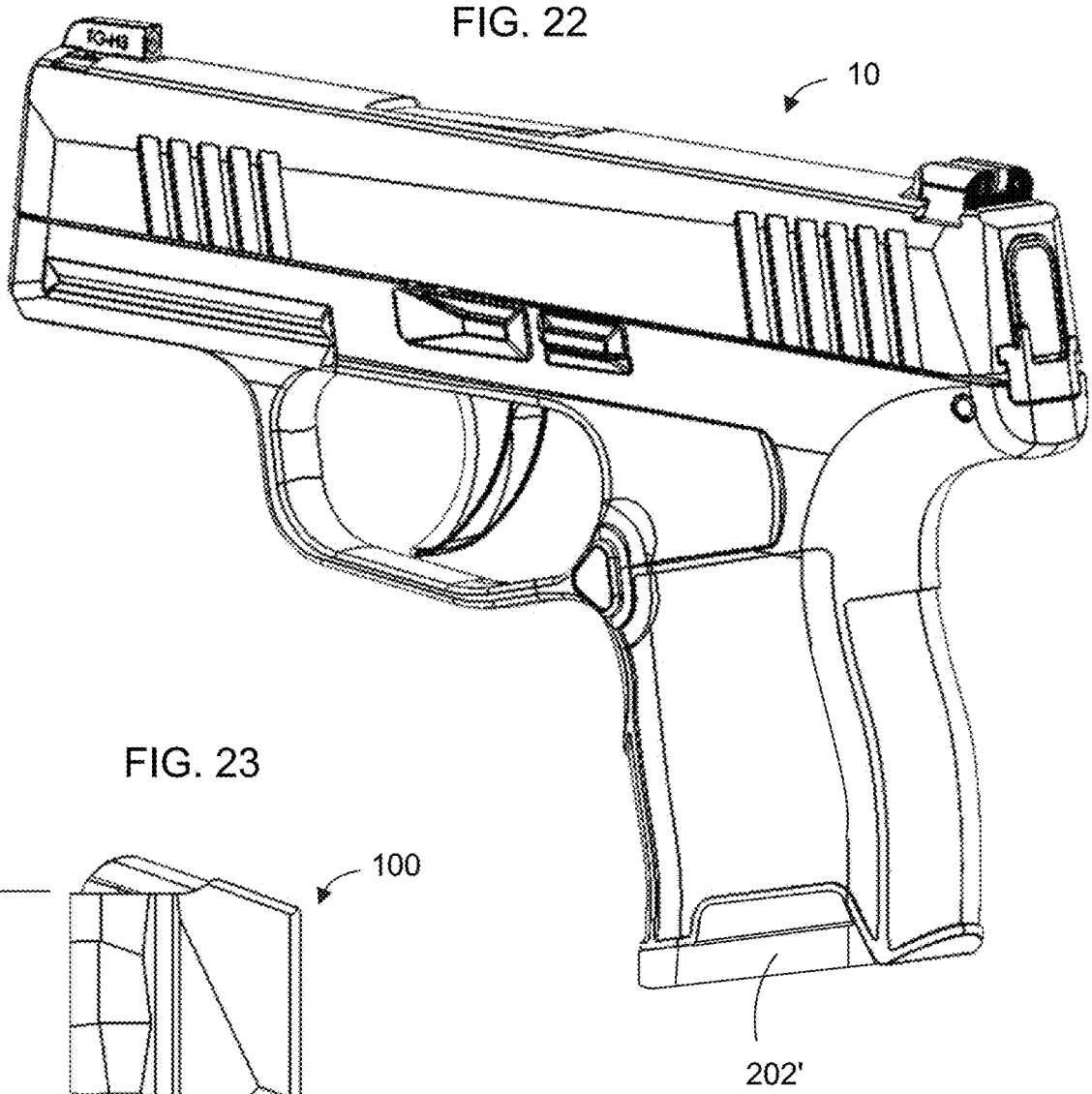
FIG. 22 illustrates a left-side, rear, and top perspective view of a handgun with pistol magazine installed in the magazine well in accordance with another embodiment of the present disclosure.

Embodiments of magazine 100 are configured as a detachable box magazine for a semiautomatic handgun 10 (shown, for example, in FIGS. 20-22). Magazine 100 has a hollow magazine tube 110 extending longitudinally along a central axis 101 and having a bottom tube end portion 112 and an upper tube end portion 116. Bottom tube end portion 112 defines a bottom tube opening 114 and upper tube end portion 116 defines an upper tube opening 118. In embodiments, magazine 100 includes a floorplate assembly 200, spring 220, and a follower 190. Follower 190 is biased by spring 220 toward upper tube end portion 116 and protrudes slightly from upper tube opening 118 when magazine 100 contains no ammunition. Floorplate assembly 200 is removably attached to bottom tube end portion 112 to selectively close bottom tube opening 114. Embodiments of floorplate assembly 200 are discussed in more detail below.

Magazine tube 110 generally has a rectangular cross-sectional shape that can be bisected by a median plane 102 extending therethrough to define a left portion 104 and a right portion 106 that are generally symmetrical to each other. Magazine tube 110 includes a front tube sidewall 120, a rear tube sidewall 122, a left tube sidewall 124 on a first or left side of median plane 102, and a right tube sidewall 126 on a second or right side of median plane 102. Magazine tube 110 defines a single-stack portion 130 extending down from upper tube end portion 116. A double-stack portion 150 is positioned below single-stack portion 130 and includes bottom tube end portion 112.

Magazine tube 110 defines front lateral margins 132, 134 between front tube sidewall 120 and each of left tube sidewall 124 and right tube sidewall 126, respectively. Front lateral margins 132, 134 can be rounded, flattened, or define a corner. Each of opposite front lateral margins 132, 134 of front sidewall 120 has a stepped shape between upper tube end portion 116 and double-stack portion 150. For example, the stepped shape has a first sloped portion 140 located adjacent upper tube end portion 116 and extending downward and laterally outward from median plane 102. A vertical section 142 extends from first sloped portion 140 downward generally parallel to median plane 102 to a second sloped portion 144 extending from vertical section 142 downward and laterally outward from median plane 102 to double-stack portion 150.

In some embodiments, each of first sloped portion 140, vertical section 142, and second sloped portion 144 has a vertical height H sufficient to accommodate one or more ammunition cartridge 50. In other embodiments, vertical height H of any one or more of first sloped portion 140, vertical section 142, or second sloped portion 144 can be sized to accommodate more than one ammunition cartridge 50. Accordingly, when loaded with two, three, or more ammunition cartridges 50, single-stack portion 130 contains at least two ammunition cartridges 50 with projectiles 52 aligned vertically along median plane 102. The stepped shape causes projectiles 52 of adjacent ammunition cartridges 50 to attain a vertically aligned position through single-stack portion 130. In some embodiments, two projectiles 52, three projectiles 52, or other number of projectiles 52 are aligned vertically along median plane 102 through single-stack portion 130.

Opposite rear lateral margins 136, 138 of rear tube sidewall 122 have a linear taper between the upper tube end portion 116 and double-stack portion 150. When magazine 100 is filled to capacity with ammunition cartridges 50, heads 54 of adjacent cartridges 50 are laterally offset toward opposite sides of the median plane 102 along the single-stack portion 130 to varying amounts as dictated by rear lateral margins 136, 138. That is, as cartridges 50 approach upper tube end portion 116, each cartridge 50 is closer to attaining an orientation with the head 54 and projectile 52 both being aligned along (or close to being aligned along) median plane 102. In double-stack portion 150, the heads 54 and projectiles 52 of adjacent cartridges 50 are laterally offset from median plane 102, where ammunition cartridges 50 extend longitudinally generally parallel to median plane 102. As cartridges 50 are fed to the handgun 10, cartridges 50 are biased towards upper tube opening 118 by follower 190 and spring 220.

In some embodiments, second sloped portion 144 is a transition portion between single-stack portion 130 and double-stack portion 150 in which projectiles 52 of ammunition cartridges 50 are not aligned along median plane 102 as in single-stack portion 130, but also are not laterally offset on opposite sides of median plane 102 to the extent as in double-stack portion 150. In other words, cartridges 50 moving through second sloped portion 144 are in the process of transitioning from a double-stack configuration to a single-stack configuration or vice versa. In one embodiment, magazine tube 110 has a tube width $W_t$ of no more than 20.7 mm, a tube height $H_t$ of no more than 90.5 mm as measured along the front tube sidewall 120, and a capacity of 12 rounds of 9 mm Luger ammunition.

Referring now to FIG. 8, an exploded, perspective view shows components of magazine 100, in accordance with an embodiment of the present disclosure. Bottom tube end portion 112 of magazine tube 110 defines a left bottom lip 152 and a right bottom lip 154. Right bottom lip 154 extends transversely inward toward median plane 102 from right tube sidewall 126. Similarly, left bottom lip 152 (not visible) extends transversely inward toward median plane 102 from left tube sidewall 124. Left bottom lip 152 and right bottom lip 154 are useful to engage overhang 217 of floorplate 202 as discussed in more detail below. All or part of floorplate assembly 200 is configured for removable attachment to bottom tube end portion 112 to selectively close bottom tube opening 114.

Figure 9:
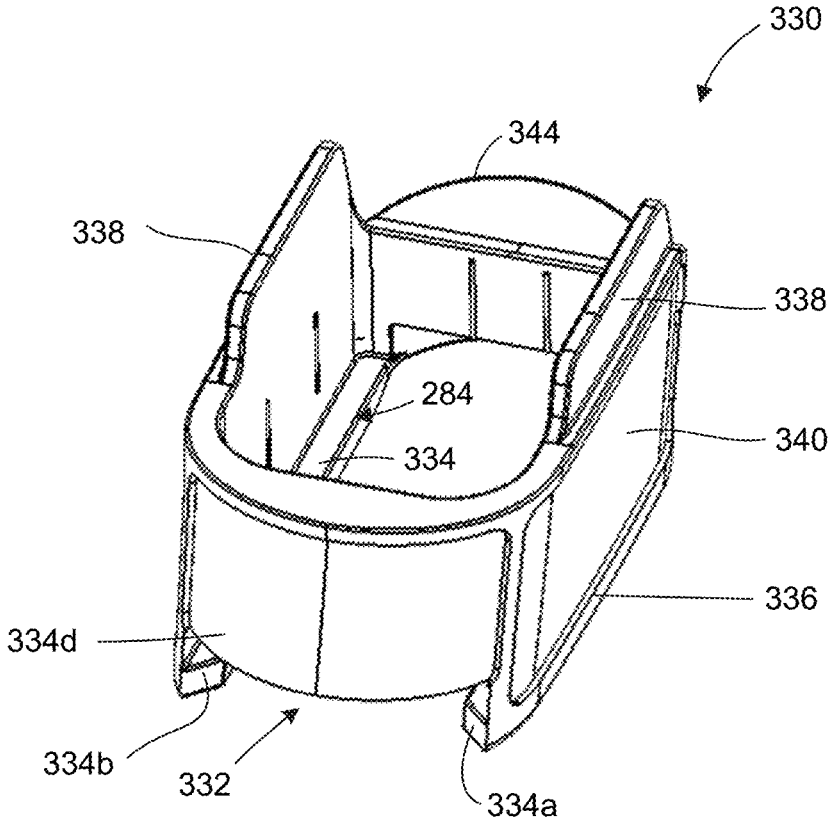
FIG. 9 illustrates a front, left-side, and top perspective view of a grip extension in accordance with an embodiment of the present disclosure.
Figure 10:
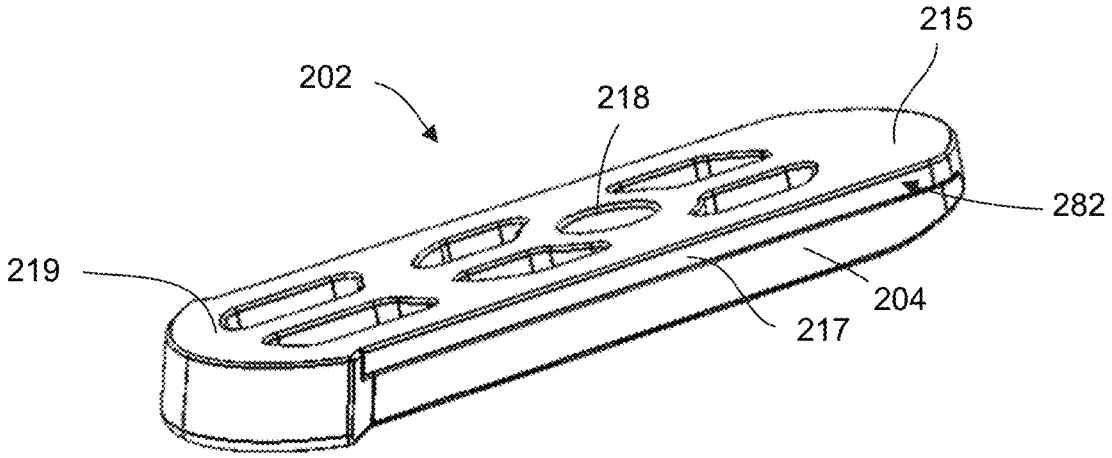
FIG. 10 illustrates a left-side, front, and top perspective view of a floor plate in accordance with an embodiment of the present disclosure.
Figure 11:
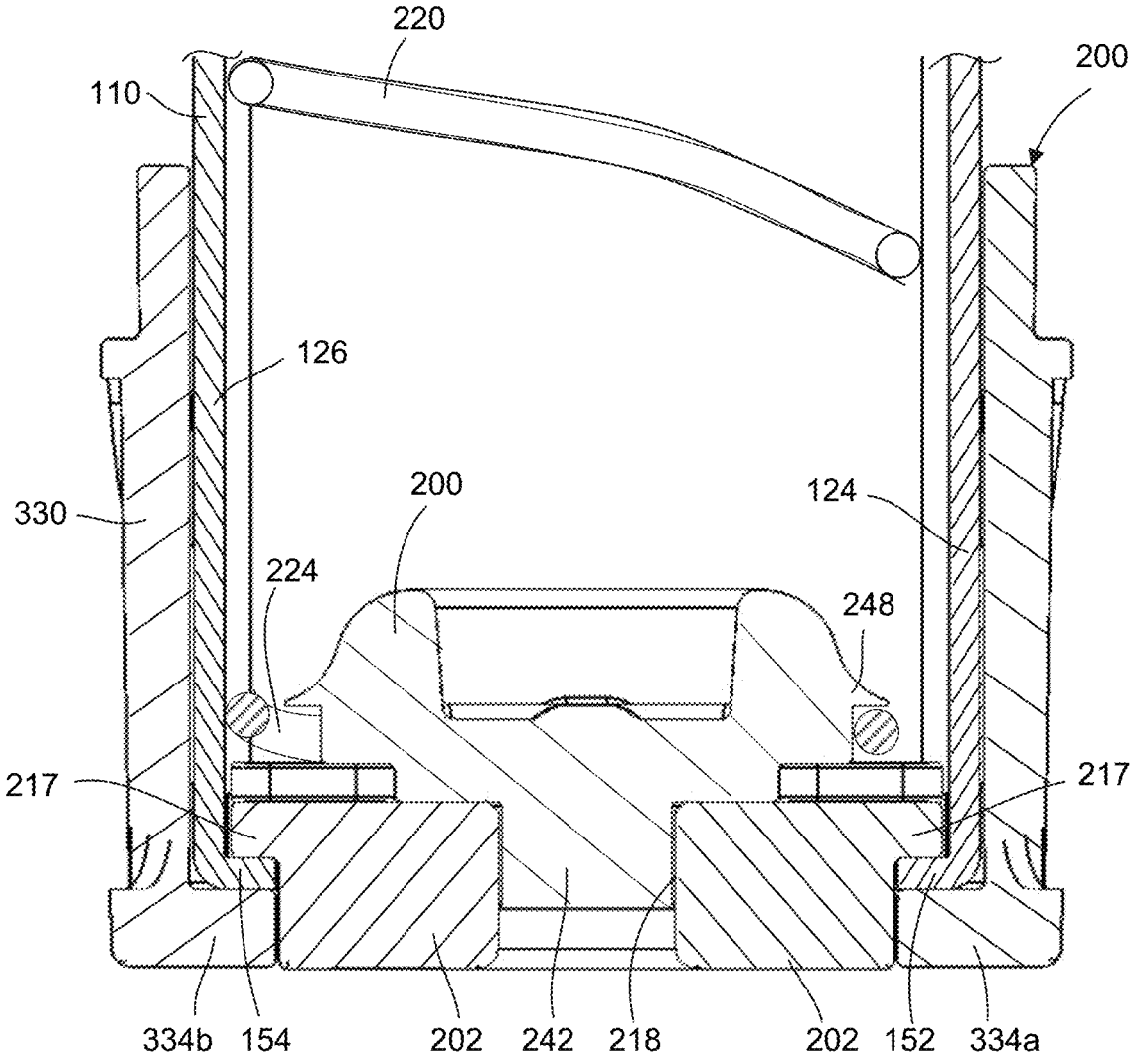
FIG. 11 illustrates a front cross-sectional view of a lower end portion of a pistol magazine showing structures to retain the grip extension on the magazine tube in accordance with an embodiment of the present disclosure.

Referring now to FIGS. 8-11, components of floorplate assembly 200 are illustrated in accordance with an embodiment of the present disclosure. FIG. 8 illustrates an exploded view of floorplate assembly 200 with other components of magazine 100; FIG. 9 illustrates a front, top, and left-side perspective view of one embodiment of grip extension 330; FIG. 10 illustrates a left-side perspective view of one embodiment of floorplate 202 usable with grip extension 330; and FIG. 11 illustrates a front cross-sectional view of a lower portion of magazine 100 showing spring 220, floorplate assembly 200, and magazine tube 110 in an assembled position.

Floorplate 202 is configured to slidingly engage bottom tube end portion 112 to selectively close bottom tube opening 114. Floorplate 202 also engages grip extension 330 to retain grip extension 330 on magazine tube 110. For example, a first retaining structure 282 on floorplate 202 cooperates with a second retaining structure 284 on grip extension 330 and/or bottom tube end portion 112 to close bottom tube opening 114 and secure grip extension 330 to magazine tube 110. In one embodiment, first retaining structure 282 is a protrusion or overhang 217 along and extending laterally from sidewall 204 of floorplate 202. For example, overhang 217 can be a lip, rail, ridge, tab, plurality of tabs, or other feature that can mate with second retaining structure 284 on grip extension 330 and/or magazine tube 110. In some embodiments, first retaining structure 282 is received by, interlocks with, overlaps, or engages second retaining structure 284, or vice versa. In some embodiments, first retaining structure 282 on floorplate 202 cooperates with both grip extension 330 and bottom tube end portion 112 of magazine tube 110. For example, first retaining structure 282 defines a recess, slot, or groove in sidewall 204 that receives rim 334 of grip extension 330 and left bottom lip 152 and right bottom lip 154 of magazine tube 110. For example, the vertical height of the recess along the right sidewall portion **204*b* is the same or about the same as the combined vertical thickness of the right rim portion 334*b* and right bottom lip 154; the left sidewall portion 204*a*** can be similarly constructed.

In the example embodiment of FIG. 8, second retaining structure 284 includes left bottom lip 152 and right bottom lip 154 of magazine tube 110 as well as toe portion 342 of grip extension 330 with opening 332 configured to mate with floorplate toe 219. In one embodiment, second retaining structure 284 includes rim(s) 334 on grip extension 330 that extends inward towards median plane 102 to abut bottom tube end portion 112 of magazine tube 110. For example, rims 334 extend transversely inward from grip sidewalls 340 and overlaps left bottom lip 152 and right bottom lip 154 on bottom tube end portion 112.

In one embodiment, floorplate 202 is slidingly received through an opening 332 defined in toe portion 342 of grip extension 330. First retaining structure 282 includes overhangs 217 on opposite sides of floorplate 202 that are constructed to overlap right bottom lip 154 and left bottom lip 152 of magazine tube 110. When grip extension 330 is on magazine tube 110, left bottom lip 152 and right bottom lip 154 abut and/or overlap left rim portion 334*a* and right rim portion 334*b* of grip extension 330, respectively. Such engagement can prevent grip extension 330 from sliding up further onto magazine tube 110. When assembled as shown in FIG. 1, for example, floorplate toe 219 occupies and closes opening 332 of grip extension 330. In doing so, floorplate toe 219 overlaps and mates with toe portion 342 of grip extension 330 to prevent grip extension 330 from moving downward on magazine tube 110. Floorplate heel 215 may also overlap and/or engage heel portion 344 of grip extension 330. When assembled, these overlapping surfaces secure grip extension 330 to magazine tube 110.

As shown in FIG. 8, spring 220 is generally configured as a coil spring with a lower spring portion 202 and an upper spring portion 206. Spring 220 is shaped and configured to be disposed in magazine tube 110 and compressible between an expanded state (or less compressed state) and a compressed state. When assembled with magazine tube 110, spring 220 extends between floorplate 202 and follower 190 with a spring bottom end 224 engaging spring plate 240 and a spring top end 228 engaging follower 190. For example, spring bottom end 224 defines a generally flat end coil that wraps around and grips spring plate 240. In another example, spring top end 228 defines a coil, at least a portion of which is received in a recess or hollow in a bottom of follower 190.

Spring 220 exerts a spring force axially between follower 190 and floorplate 202, thereby biasing follower 190 towards upper tube opening 118. Lower spring portion 222 includes a plurality of larger spring coils commensurate in size and shape with double-stack portion 150 of magazine tube 110. Upper spring portion 226 includes a plurality of smaller spring coils 232 commensurate in size and shape with single-stack portion 130. In one embodiment, spring 220 includes three, four, or more smaller spring coils 232 and two, three, or more larger spring coils 230. In some embodiments, spring 220 has more smaller spring coils 232 than larger spring coils 230. In some embodiments, larger spring coils 230 of lower spring portion 222 have a greater pitch than smaller spring coils 232 of upper spring portion 226. Unlike other springs that generally have a consistent pitch and consistent coil size along the spring length, embodiments of spring 220 having smaller spring coils 232 and larger spring coils 230 enables spring 220 to have a reduced solid height when fully compressed since smaller spring coils 232 can compress into larger spring coils 230. This feature reduces the overall vertical size of spring 220 in a fully compressed state, thereby reducing the required vertical space for magazine 100 with capacity for a given number of rounds.

FIG. 9 illustrates a front and top perspective view of grip extension 330 in accordance with an embodiment of the present disclosure. Grip extension 330 is configured to be removably installed over double-stack portion 150 of magazine tube 110 adjacent bottom tube opening 114 with left bottom lip 152 and right bottom lip 154 of magazine tube 110 abutting rim 334. Grip extension 330 extends between a bottom grip end portion 336 and a top grip end portion 338 with a generally annular shape sized and configured to receive bottom tube end portion 112 of magazine tube 110. In some embodiments, top grip end portion 338 is shaped to mate with and/or align with handgrip 15 of handgun 10 when magazine 100 is seated in the magazine well as shown, for example, in FIGS. 20-21. In one embodiment, bottom grip end portion 336 defines second retaining structure 282 that mates with first retaining structure 284 on floorplate 202. Grip extension 330 and floorplate 202 can be made of a variety of materials, including molded polymers, wood, metal, and other suitable materials. In some embodiments, grip extension 330 comprises a substrate made of a rigid material (e.g., metal) and a grip material molded over the substrate (e.g., rubber or plastic). Numerous configurations and variations will be apparent in light of this disclosure.

FIG. 11 illustrates a front sectional view of a lower part of magazine 100 showing floorplate assembly 200 and grip extension 330 installed on magazine tube 110. Overhangs 217 along floorplate sidewalls 204 overlap rim 334 and engage left bottom lip 152 and right bottom lip 154 of magazine tube 110. Left rim portion 334*a* and right rim portion 334*b* of grip extension 330 extend together with and overlap left bottom lip 152 and right bottom lip 154, respectively. Spring plate protrusion 242 extends into protrusion opening 218 of floorplate 202, thereby preventing floorplate 202 from moving forward or backward with respect to grip extension 330. To remove floorplate 202, the user may push spring plate protrusion 242 up through protrusion opening 218 and out of engagement with floorplate 202, thereby permitting floorplate 202 to slide out from magazine tube 110 and grip extension 330.

Figure 12:
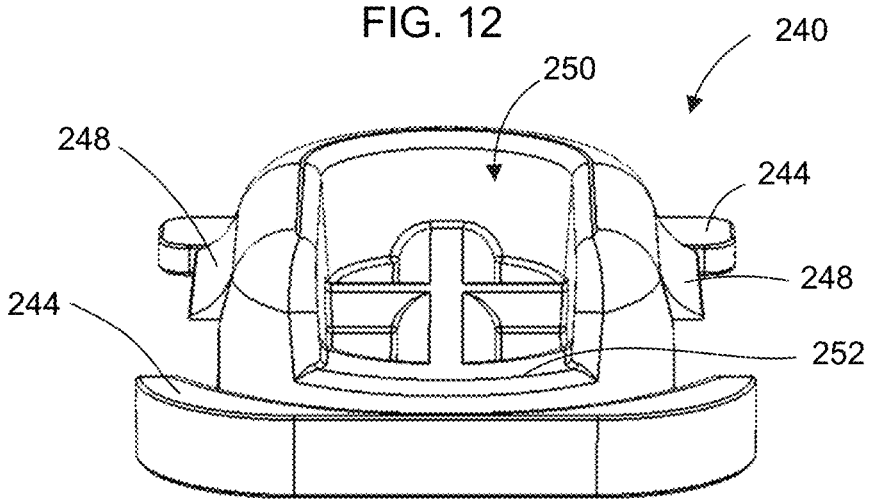
FIG. 12 illustrates a front and top perspective view of a spring plate in accordance with an embodiment of the present disclosure.
Figure 13:
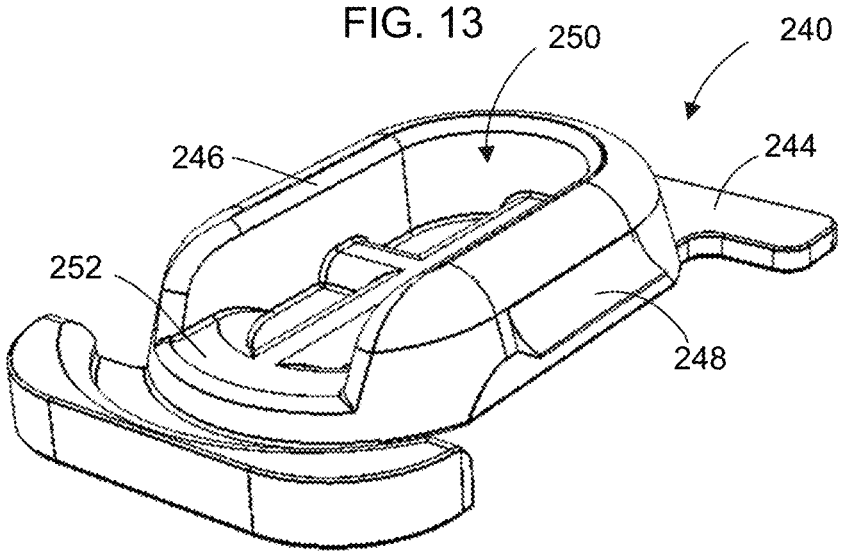
FIG. 13 illustrates a front, top, and left-side perspective view of the spring plate of FIG. 12.
Figure 14:
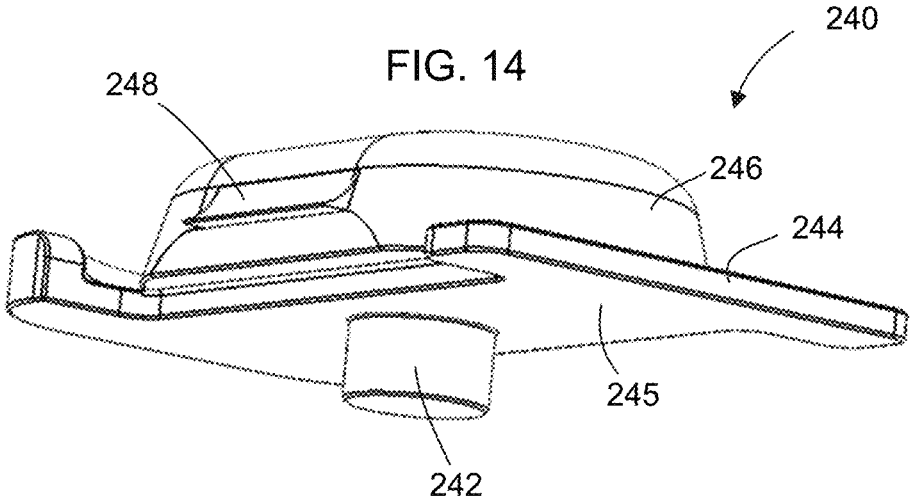
FIG. 14 illustrates a bottom, rear, and left-side perspective view of the spring plate of FIG. 12 showing a protrusion extending from the bottom face of the plate body in accordance with an embodiment of the present disclosure.

Referring now to FIGS. 12-14 and with continued reference to FIGS. 8 and 11, spring plate 240 is illustrated in accordance with an embodiment of the present disclosure. FIG. 8 shows spring plate 240 in an exploded view with other components of magazine 100; FIG. 11 illustrates a front cross-sectional view of spring plate 240 assembled with grip extension 330 and magazine tube 110; FIG. 12 illustrates a front and top perspective view of spring plate 240; FIG. 13 illustrates a front, top, and left-side perspective view of spring plate 240; and FIG. 14 illustrates a bottom, rear, and left-side perspective view of spring plate 240.

In one embodiment, spring plate 240 is configured to abut a floorplate top surface 208 with a spring plate protrusion 242 extending into a protrusion opening 218 defined in floorplate 202. Spring bottom end 224 can be wrapped partially around spring plate 240 and retained by one or more wire catches 248. A spring top end 228 engages follower 190. When installed in magazine tube 110 and assembled with floorplate assembly 200, spring 220 is at least partially compressed to bias spring plate 240 against floorplate 202 with spring plate protrusion 242 extending into protrusion opening 218 in floorplate 202. Features of the components shown in FIG. 8 are discussed in more detail below.

Spring plate 240 is configured to be attached to or coupled to spring bottom end 204 and also configured to abut floorplate top surface 208. In embodiments, spring plate 240 has a plate base 244 with a generally flat bottom surface 245 (except for protrusion 242) shaped to correspond with that of floorplate 202. In one embodiment, a spring plate body 246 extends axially upward from plate base 244 and is shaped and configured to engage spring bottom end 224. For example, a spring plate body 246 generally has an oval shape around which wraps a flat coil of spring bottom end 224. In some embodiments, spring plate body 246 defines one or more wire catches 248 extending laterally therefrom and configured to overlap or otherwise engage wire of spring bottom end 224 to maintain spring 220 coupled to spring plate 240. For example, wire of spring bottom end 224 wraps around spring plate body 246 and is positioned axially between plate body 244 and wire catches 248. In one embodiment, spring plate body 246 defines a body recess 250 sized to receive at least one smaller spring coils 232 when spring 220 is fully compressed. For example, as spring 220 is compressed, larger spring coils 230 flatten against one another while wrapping around spring plate body 246. As spring 220 transitions to smaller spring coils 232, the wire of spring 220 enters an open end 252 of spring plate body 246, followed by smaller spring coils 232 stacking within body recess 250. Features of spring plate 240 reduce the overall vertical size of spring plate 240 when assembled with floorplate 202 and when spring 220 is in a fully compressed state, thereby providing increased vertical space for ammunition in magazine 100 with a given tube height $H_t$.

Figure 15:
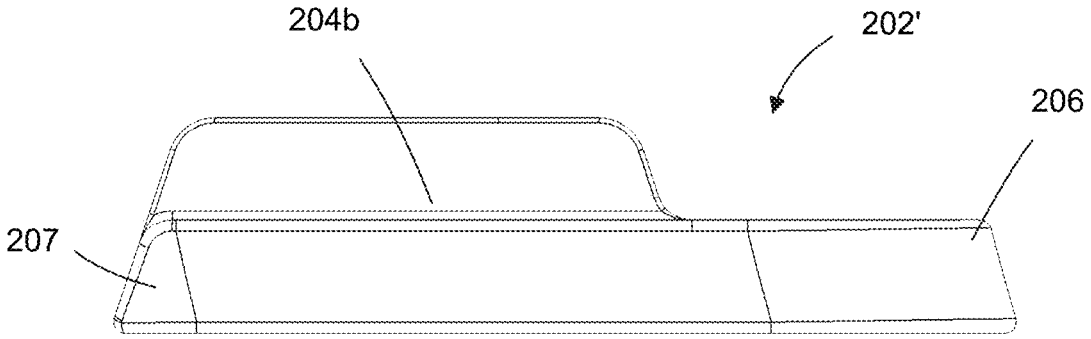
FIG. 15 illustrates a right-side elevational view of a base plate in accordance with another embodiment of the present disclosure.
Figure 16:
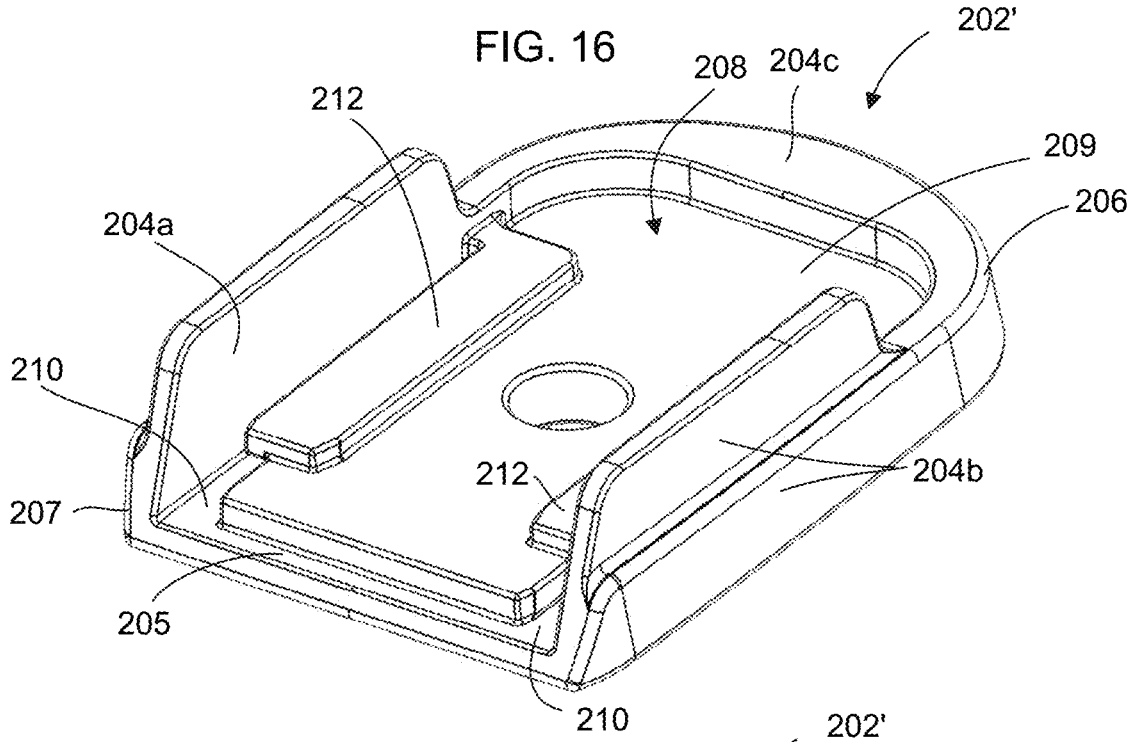
FIG. 16 illustrates a top, rear, and right-side perspective view of the base plate of FIG. 15.
Figure 17:
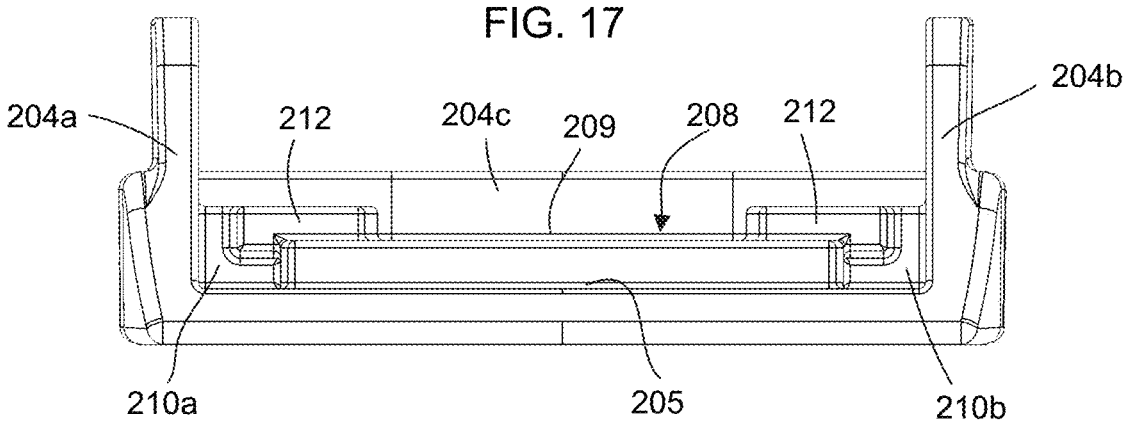
FIG. 17 illustrates a rear elevational view of the base plate of FIG. 15 showing channels on the right and left sides in accordance with an embodiment of the present disclosure.

Referring now to FIGS. 15-17, another embodiment of floorplate 202' is illustrated. FIG. 15 illustrates a right-side elevational view; FIG. 16 illustrates a top, rear, and right-side view; and FIG. 17 illustrates a rear elevational view of floorplate 202'. When floorplate 202' is part of floorplate assembly 200, grip extension 330 is omitted. Similar to embodiments of floorplate 202 discussed above, when assembled with magazine tube 110, floorplate 202' slidably engages bottom tube end portion 112 to close bottom tube opening 114.

Floorplate 202' has a floorplate sidewall 204 extending along sides and front 206 of floorplate 202'. Sidewall 204 includes left sidewall portion 204*a* and a right sidewall portion, and a front sidewall portion 204*c* each extending transversely up from (e.g., perpendicular to) a floorplate base 205 constructed to receive bottom tube end portion 112. Floorplate base 205 defines a spring plate region 209 recessed below sidewall 240.

In one embodiment, spring plate region 209 generally has an I-shape with a depth to accommodate plate base 244 of spring plate 240. In some embodiments, plate base 244 is flush with or recessed below top surface 208 of shelves 212 and front sidewall portion 204*c*. By being recessed below front sidewall portion 204*c*, spring plate region 209 reduces the overall vertical size of floorplate assembly 200, thereby requiring less vertical space for a given number of rounds in magazine 100. In some embodiments, spring plate region 209 has a shape corresponding to that of plate base 244 as discussed above, for example. Accordingly, plate base 244 is received in spring plate region 209, where the structures interlock to prevent movement of spring plate 240 on floorplate top surface 208. For example, plate base 244 has an I-shape that is received in spring plate region 209 also having an I-shape. Other shapes are acceptable.

Floorplate base 205 defines an outer channel 210 recessed below and extending between spring plate region 209 and sidewall 204. In one embodiment, outer channel 210 has a U-shape extending along left and right sidewall portions 204*a*, 204*b* and rear 207 of floorplate 202. Outer channel 210 of floorplate 202 defines a left channel portion 210*a* along left sidewall portion 204*a* and a right channel portion 210*b* along right sidewall portion 204*b*, each configured to slidingly receive left bottom lip 152 and right bottom lip 154, respectively. Shelves 212 extend up from top surface 208 of spring plate region 209 and laterally over part of outer channel 210 to define a catch to engage each of left bottom lip 152 and right bottom lip 154 and maintain floorplate 202 attached to bottom tube end portion 112. In other words, outer channel 210 undercuts shelves 212.

Figure 18:
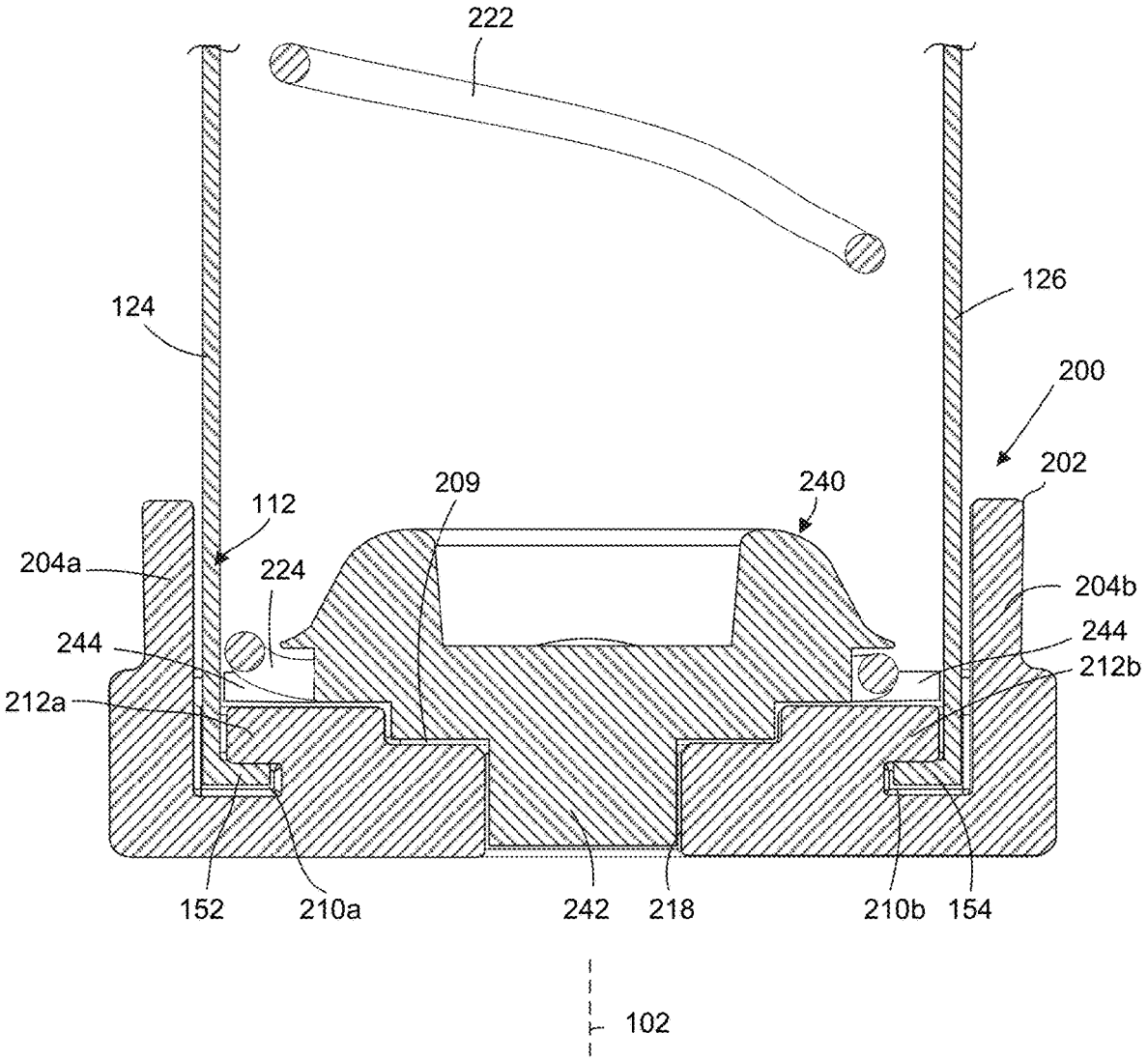
FIG. 18 illustrates a front cross-sectional elevation of a lower end portion of a pistol magazine showing the spring plate partially recessed into the floor plate in accordance with an embodiment of the present disclosure.

As shown in FIG. 18, when floorplate 202 is attached to bottom tube end portion 112, floorplate 202 slidingly engages left bottom lip 152 and right bottom lip 154 with left sidewall portion 204*a* adjacent the left tube sidewall 124 and right sidewall portion 204*b* adjacent right tube sidewall 126. For example, a left shelf 212*a* extends from spring plate region 209 toward left sidewall portion 204*a* and partially over the left channel 210*a* and a right shelf 212*b* extends from spring plate region 209 toward right sidewall portion 204*b* and partially over right channel 210*b*. Left bottom lip 152 is captured in left channel 210*a* and right bottom lip 154 is captured in right channel 210*b*, thereby preventing removal of floorplate 202 from magazine tube 110 in an axial direction (e.g., downward). Compared to magazines that have an outward-extending flange or lip at the bottom end of the magazine tube, magazine tube 110 according to some embodiments of the present disclosure can have a reduced lateral thickness due to left bottom lip 152 and right bottom lip 154 extending inward towards median plane 102, rather than outward.

When assembled with magazine tube 110, spring 220 is somewhat compressed and exerts a force on floorplate 202 with spring plate 240 seated in spring plate region 209, in accordance with some embodiments. To secure floorplate assembly 200 to magazine tube 110 and prevent inadvertent disassembly, spring plate 240 defines a spring plate protrusion 242 that extends into an opening 218 through floorplate 220 when in the seated position. Spring plate 240 prevents floor plate 202 from being removed from magazine tube 110 since plate base 244 would be blocked by contact with magazine tube 110. However, pushing spring plate 240 upward to disengage spring plate protrusion 242 from protrusion opening 218 would allow floor plate 202 to be slidingly removed. Thus, to disassemble magazine 100, the user can press spring plate protrusion 242 (and spring plate 240 as a whole) axially into magazine tube 110 so that protrusion 242 clears floorplate 202 and permits floorplate 202 to slide off of bottom tube end portion 112.

Figure 19A:
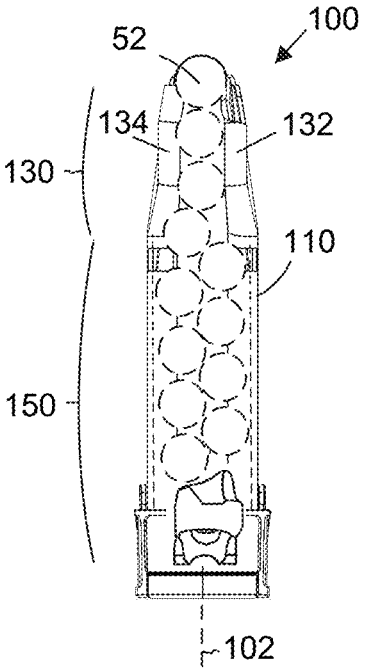
FIG. 19A illustrates a front elevational view of the pistol magazine of FIG. 1 showing an example of an ammunition stacking configuration of a fully loaded magazine in accordance with an embodiment of the present disclosure.
Figure 19B:
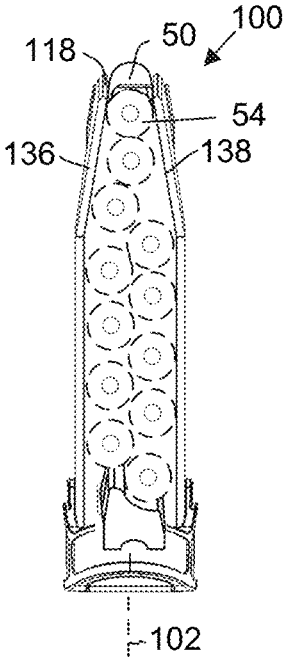
FIG. 19B illustrates a rear elevational view of the pistol magazine and ammunition of FIG. 19A.
Figure 19C:
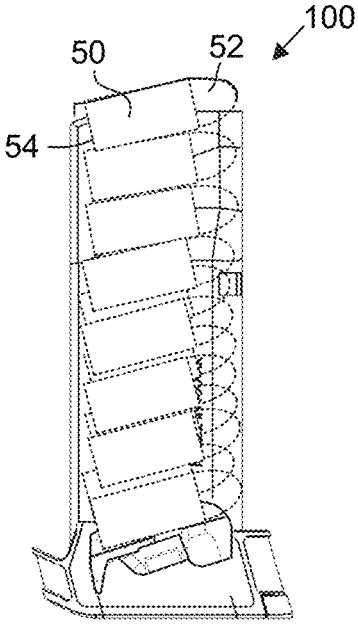
FIG. 19C illustrates a right-side elevational view of the pistol magazine and ammunition of FIG. 19A.

Referring now to FIGS. 19A-19C, magazine 100 is illustrated fully loaded with cartridges 50 in front, rear, and side views, respectively, and show example positions of cartridges 50 in the single-stack portion 130 and double-stack portion 150, in accordance with an embodiment of the present disclosure. FIG. 19A illustrates a front elevational view of magazine 100 showing projectiles 52 aligned along single-stack portion 130 of magazine tube 110. The top three projectiles 52 are aligned tightly along median plane 102 in the single-stack portion 130. Projectile 52 of the fourth cartridge is still generally aligned with the top three projectiles 52, but is transitioning towards the offset stacked arrangement of double-stack portion 150. Note that front lateral margins 132, 134 along single-stack portion 130 of magazine tube 110 have a stepped shape between double-stack portion 150 and upper tube opening 118. FIG. 19B illustrates a rear elevational view of magazine 100 showing heads 54 of cartridges 50 in an offset stack through the double-stack portion 150 and moving into alignment along medial plane 102 going through single-stack portion 130. Note that heads 54 may be less aligned than projectiles 52 in the lower portion of the single-stack portion 130, for example. Also note that rear lateral margins 138, 136 of magazine tube 110 along single-stack portion 130 can have a straight taper between double-stack portion 150 and upper tube opening 118. FIG. 19C is a side view showing an example of cartridges 50 in fully-loaded magazine 100.

FIG. 20 illustrates a left side and rear perspective view of an embodiment of a handgun 10 assembled with magazine 100, in accordance with an embodiment of the present disclosure. With magazine 100 seated in the magazine well, grip extension 330 mates with the bottom end of handgrip 15. FIG. 21 illustrates a rear elevational view of handgun 10 of FIG. 20 and shows first lateral thickness $T_1$ at web region 17 of handgun 10 where the web between one's thumb and index finger engage the backstrap 16 of the handgrip 15. Handgrip 15 has a second lateral thickness $T_2$ along palm region 18 as handgrip 15 extends towards grip extension 330. First lateral thickness $T_1$ at web region 17 is reduced compared to second lateral thickness $T_2$ at palm region 18 in some embodiments. First lateral thickness $T_1$ at web region 17 is reduced compared to the web region of other handguns utilizing a double-stack magazine. Overall, due to the magazine 100 having single-stack portion 130 and double stack portion 150 as described herein, handgun 10 includes the combined benefit of increased ammunition capacity and reduced width along at least part of the grip length compared to other designs utilizing a traditional double-stack magazine. The reduced first lateral thickness $T_1$ of the web region 17 further provides comfort and ergonomic benefits by enabling a power grip and profile conducive to increased control on the handgun 10. In one example, a grip module 20 of handgun 10 is configured to be grasped by a user with web region 17 between a thumb and index finger and a palm region 18 abutting the user's palm with at least some of the user's fingers wrapped around the handgrip 15. In one example, the second lateral thickness $T_2$ along the palm region 18 is no greater than 30 mm, such as no more than 29 mm, no more than 28 mm, no more than 27 mm, no more than 26 mm, or no more than 25 mm. In some embodiments, first lateral thickness $T_1$ of the web region is less than second lateral thickness T2. For example, first lateral thickness $T_1$ is no more than 25 mm, such as no more than 24 mm, no more than 23 mm, no more than 22 mm, or no more than 21 mm.

Figure 23:
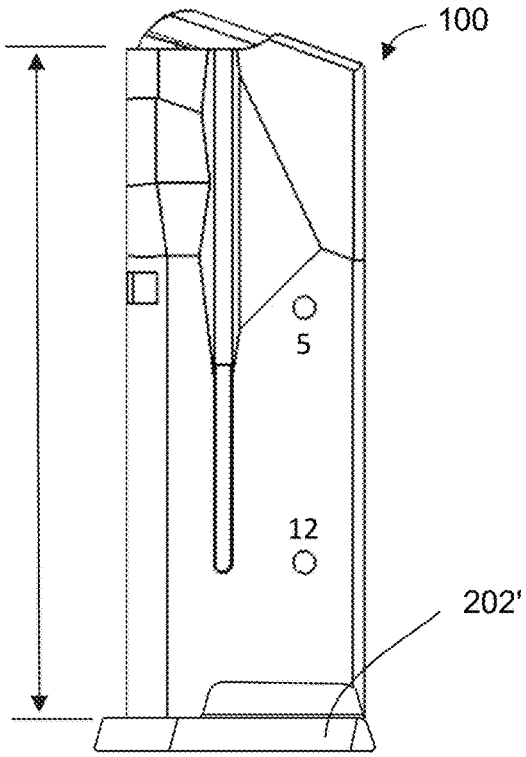
FIG. 23 illustrates a left-side elevational view of a magazine with the floor plate of FIGS. 15-17 in accordance with an embodiment of the present disclosure.

FIG. 22 illustrates a left side perspective view of another embodiment of handgun 10 with magazine 100 seated in the magazine well, where magazine 100 is equipped with a flush floorplate 202' as shown, for example, in FIGS. 15-17. FIG. 23 illustrates a side elevational view of an embodiment of magazine 100 shown in FIG. 22 with the flush floorplate 202' (omitting grip extension 330).

In use, magazine 100 in accordance with embodiments of the present disclosure includes a magazine tube with both single-stack portion 130 and double-stack portion 150. Additional features of some embodiments include grip extension 330, spring plate 240 recessed at least partially into floorplate 202, and a spring 220 with a section of smaller spring coils 232 and a section of larger spring coils 230. Embodiments of magazine 100 advantageously enable handgun 10 to provide increased magazine capacity compared to guns with single-stack magazines while also providing a reduced grip thickness compared to guns with conventional double-stack magazines. Embodiments of magazine 100 enable first lateral thickness $T_1$ of handgrip 15 where the user grips the handgrip 15 with the thumb and index finger to be reduced compared to second lateral thickness $T_2$ along the user's palm. Such a feature can provide improved comfort and greater control over the handgun 10 during firing. Further, handgun 10 can be formed with and ergonomic grip shape to reduce sliding or rotation of the handgun within the user's hand, such as a non-cylindrical shape, a non-uniform diameter, a relatively greater thickness along the central portion, or other features facilitated by magazine 100.

In addition, some embodiments of magazine 100 provide a reduced vertical size required for a given ammunition capacity, thereby facilitating a reduced grip length of handgun 10 for a given magazine capacity. For example, spring plate 240 is at least partially recessed into base plate 202. In another example, smaller spring coils 232 of spring 220 can be received in body recess 250 of spring plate 240. Such features reduce the required vertical height of magazine 100 and therefore enable a greater ammunition capacity for a given magazine length.

Embodiments of magazine 100 of the present disclosure also enable a handgun 10 to have improved ergonomics compared to handguns designed for conventional double-stack magazines. Some embodiments of magazines 100 of the present disclosure enable handgrip 15 to have a narrow web region 17 with first lateral thickness $T_1$ where gripped by the user's thumb and index finger, and a thicker grip body or palm region 18 with second lateral thickness $T_2$. Such a grip allows the user to employ a "power grip" with the user's fingers wrapped around the grip where the user better prevents rotation or sliding of the grip in the hand. The narrower web region 17 also enables an intermediate grip circumference that facilitates fine motor skills of the index finger while using the forearm strength of a power grip. The thicker palm region 18 can have a circumference sized for a power grip and increased surface area against the user's hand for reduced slip and increased torsional control of the handgun. Further, the change in grip thickness along the grip from the web region 17 to the palm region 18 provides a varied profile that is less prone to slip or move in the user's hand. These and other ergonomic features enhance the user's grip on the handgun and therefore control of the handgun while shooting.

As will be appreciated in light of this disclosure, embodiments of magazine 100 described herein are not limited to use with handguns and may also be utilized with any of a wide variety of host firearms 1000 including long guns, short-barreled rifles, machine guns, and shotguns. Magazine 100 can be configured for pistol ammunition, rifle ammunition, non-lethal ammunition (e.g., Simunition® training ammunition), ammunition blanks, starter rounds, and other ammunition ranging from .22 LR to 30 mm NATO and everything in between (e.g., .22 LR, .223 Remington, .30 Remington, .380 Auto, .40 S&W, .45 Auto, .50 BMG, 5.56×45 mm NATO, 7.62×39 mm, 7.62×51 mm, 7.62×54 mm, 9×19 mm, 10×25 mm, 30×173 mm NATO, etc.). Other embodiments of magazine 100 can be constructed for shotgun ammunition or other rimmed cartridges. Magazine 100 may be utilized with other suitable host weapons 1000 and ammunition sizes and types as will be apparent in light of this disclosure.

Magazine 100 and its components may be constructed from any suitable material(s), as will be apparent in light of this disclosure. For example, some embodiments of magazine 100 are constructed from steel, polymers, composites, aluminum, or other materials. More generally, magazine 100 and its components can be constructed from any suitable material compliant, for example, with United States Defense Standard MIL-W-13855 (Weapons: Small Arms and Aircraft Armament Subsystems, General Specification For). Other suitable materials for magazine 100 will depend on a given application and will be apparent in light of this disclosure.

In some cases, magazine 100 optionally can be configured to be operatively interfaced with any of a wide variety of other firearm accessories, such as ammunition, magazine pouches, grip extensions, speed loaders, and other equipment. Other suitable accessories with which magazine 100 optionally may be interfaced will depend on a given application and will be apparent in light of this disclosure.

Further Example Embodiments

The following examples pertain to further embodiments, from which numerous permutations and configurations will be apparent.

Example 1 is a detachable box magazine comprising a hollow magazine tube extending longitudinally along a median plane, the hollow magazine tube having a front tube sidewall, a rear tube sidewall, a left tube sidewall on a left side of the median plane, and a right tube sidewall on a right side of the median plane, wherein the hollow magazine tube defines a single-stack portion and a double-stack portion positioned below the single-stack portion, the single-stack portion sized and constructed to retain at least two vertically aligned cartridges.

Example 2 includes the subject matter of Example 1, wherein opposite lateral margins of the front sidewall have a stepped shape between the double-stack portion and an upper tube end.

Example 3 includes the subject matter of any of Examples 1 or 2, wherein opposite lateral margins of the rear sidewall have a linear taper between the double-stack portion and the upper tube end.

Example 4 includes the subject matter of any of Examples 1-3, wherein when three or more cartridges are installed in the detachable box magazine, heads of adjacent cartridges of the three or more cartridges are laterally offset toward the opposite lateral margins of the rear sidewall.

Example 5 includes the subject matter of any of Examples 2-4, wherein the stepped shape comprises a first sloped portion located adjacent the upper tube end and extending downward and laterally outward from the median plane, a vertical section extending from the first sloped portion downward along the median plane, and a second sloped portion extending from the vertical section downward and laterally outward from the median plane to the double-stack portion.

Example 6 includes the subject matter of Example 5, wherein the first sloped portion, the vertical section, and the second sloped portion each have a vertical size commensurate with a cartridge to be retained in the detachable box magazine.

Example 7 includes the subject matter of Example 5, wherein the stepped shape causes projectiles of at least two cartridges to be vertically aligned along the single-stack portion when two or more cartridges are installed in the hollow magazine tube.

Example 8 includes the subject matter of Example 5, wherein the stepped shape causes projectiles of at least three cartridges to be vertically aligned along the single-stack portion when three or more cartridges are installed in the hollow magazine tube.

Example 9 includes the subject matter of any of Examples 1-8, wherein the hollow magazine tube defines a transition portion tapering from the double-stack portion to the single-stack portion.

Example 10 includes the subject matter of any of Examples 1-9 and further comprises a left bottom lip on the bottom tube end, the left bottom lip extending transversely inward toward the median plane from the left tube sidewall; and a right bottom lip on the bottom tube end, the right bottom lip extending transversely inward toward the median plane from the right tube sidewall.

Example 11 includes the subject matter of Example 10 and further comprises a floorplate configured to engage the left bottom lip and the right bottom lip when the floorplate is installed on the bottom tube end.

Example 12 includes the subject matter of any of Examples 1-10 and further comprises a grip extension on the double-stack portion of the magazine tube adjacent the bottom tube end; and a floorplate sized and configured to be installed between the grip extension and the bottom tube end, thereby retaining the grip extension on the magazine tube when the grip extension and the floorplate are installed on the magazine tube.

Example 13 includes the subject matter of Example 12, wherein the floorplate is configured to engage the left bottom lip and the right bottom lip when the floor plate is installed on the bottom tube end, and wherein the floor plate is configured to engage a front portion and/or a rear portion of the grip extension when the floor plate is installed on the bottom tube end.

Example 14 includes the subject matter of any of Examples 1-13, wherein the single-stack portion is sized and constructed to retain at least two vertically aligned cartridges.

Example 15 includes the subject matter of Example 14, wherein the single-stack portion is sized and constructed to retain at least three vertically aligned cartridges.

Example 16 includes the subject matter of any of Examples 1-15 and further comprises a spring disposed in the magazine tube and having a lower spring portion with a spring bottom end portion and an upper spring portion with a spring top end portion, wherein the upper spring portion defines a plurality of smaller spring coils each having a first coil size, and wherein the lower spring portion defines a plurality of larger spring coils each having a second coil size that is greater than the first coil size.

Example 17 includes the subject matter of Example 16, wherein the upper spring portion defines at least three smaller spring coils and the lower spring portion defines at least two larger spring coils.

Example 18 includes the subject matter of Example 16 and further comprises a spring plate abutting a top surface of the floorplate, the spring plate having a floorplate top surface defining a recess wherein one or more of the plurality of smaller spring coils is received in the recess when the spring is compressed.

Example 19 includes the subject matter of Example 18, wherein the top surface of the floorplate includes a recess sized and configured to receive the spring plate.

Example 20 includes the subject matter of Example 19, wherein the spring plate is flush with or below a portion of the floorplate top surface adjacent the recess when the spring plate is received in the recess.

Example 21 includes the subject matter of any of Examples 18-20, wherein the floorplate defines a left channel along the left floorplate sidewall and a right channel along the right floorplate sidewall, wherein the left bottom lip is received in the left channel and the right bottom lip is received in the right channel when the floorplate is installed on the bottom tube end.

Example 22 includes the subject matter of Example 21 and further comprises a left overhang extending partially over the left channel; and a right overhang extending partially over the right channel; wherein the left overhang is positioned to engage the left bottom lip and the right overhang is positioned to engage the right bottom lip.

Example 23 includes the subject matter of Examples 1-11 and 14-22, and further comprises a grip extension on the double-stack portion of the magazine tube adjacent the bottom tube end; and a floorplate configured to engage the grip extension and the bottom tube end, thereby retaining the grip extension on the magazine tube when the floorplate is installed on the tube bottom end.

Example 24 includes the subject matter of Example 23 and further comprises a left bottom lip on the bottom tube end extending transversely inward toward the median plane from the left tube sidewall; and a right bottom lip on the bottom tube end extending transversely inward toward the median plane from the right tube sidewall; wherein the grip defines a slot along the bottom grip end and the floorplate defines a first protrusion configured to be received in the slot when the floorplate is installed on the magazine tube.

Example 25 includes the subject matter of Example 24, wherein the floorplate defines a second protrusion configured to engage the left bottom lip and the right bottom lip when the floorplate is installed on the magazine tube.

Example 26 includes the subject matter of any of Examples 1-25, wherein the double-stack portion has a tube width of no more than 20.7 mm and is configured for 9 mm Luger ammunition.

Example 27 is a handgun grip module comprising a grip portion configured to be grasped by a user and defining a magazine well, the grip portion comprising a web region configured to be grasped by a user between a thumb and an index finger, the web region defining a first width; and a palm region configured to be grasped by a user's palm, the palm region defining a second width greater than the first width; and a magazine configured to be received into the magazine well, the magazine comprising a magazine tube extending longitudinally along a median plane and having a front tube sidewall, a rear tube sidewall, a left tube sidewall on a left side of the median plane, and a right tube sidewall on a right side of the median plane, the magazine tube defining a single-stack portion and a double-stack portion below the single-stack portion.

Example 28 includes the subject matter of Example 27, wherein opposite lateral margins of the front sidewall each has a stepped shape between an upper tube end and the double-stack portion.

Example 29 includes the subject matter of Examples 27 or 28, wherein the magazine is constructed to retain 9 mm cartridges.

Example 30 includes the subject matter of any of Examples 27-29, wherein the second width is no more than 27 mm.

Example 31 includes the subject matter of any of Examples 27-31, wherein the first width is no more than 23 mm.

Example 32 includes the subject matter of Example 27 and further comprises a left bottom lip on the bottom tube end, the left bottom lip extending transversely inward toward the median plane from the left tube sidewall; a right bottom lip on the bottom tube end, the right bottom lip extending transversely inward toward the median plane from the right tube sidewall; a grip extension on the double-stack portion of the magazine tube adjacent the bottom tube end; and a floorplate configured to engage the left bottom lip, the right bottom lip, and the grip extension when the floorplate is installed on the magazine.

Example 33 includes the subject matter of Example 32, wherein the floor plate is configured to engage a front portion and/or a rear portion of the grip extension when the floor plate and grip extension are installed on the magazine.

Example 34 includes the subject matter of any of Examples 27-31 and further comprises a grip extension on the double-stack portion of the magazine tube adjacent the bottom tube end; and a floorplate configured to be installed between the bottom tube end and the grip extension, thereby retaining the grip extension on the magazine tube.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

What is claimed is:

1. A handgun magazine comprising:

a magazine tube, the magazine tube having a front tube sidewall, a rear tube sidewall, a left tube sidewall, and a right tube sidewall, wherein the magazine tube defines a single-stack portion extending downward from an upper tube end and a double-stack portion positioned below the single-stack portion;

wherein part of the left tube sidewall and part of the right tube sidewall have a stepped shape between the double-stack portion and the upper tube end, the stepped shape including a first sloped portion adjacent the upper tube end, the first sloped portion extending downward and outward, a substantially vertical section extending downward from the first sloped portion, and a second sloped portion extending downward and outward from the vertical section; and wherein a rearward portion of the left tube sidewall and a rearward portion of the right tube sidewall each have a linear taper from the double-stack portion substantially to the upper tube end.

2. The handgun magazine of claim 1, wherein when the magazine contains at least two cartridges, projectiles of the cartridges in the single-stack portion are generally arranged in a single column along the front tube sidewall, the single column being the only column of projectiles between the left tube sidewall and the right tube sidewall in the single-stack portion.

3. The handgun magazine of claim 1, wherein the vertical section and the second sloped portion each have a vertical height sufficient to accommodate one ammunition cartridge.

4. The handgun magazine of claim 1, wherein each adjacent cartridge in the single-stack portion is aligned one above the other in a single vertical stack.

5. The handgun magazine of claim 4, wherein when the handgun magazine is loaded, the double-stack portion includes exactly two columns of cartridges in a double stack.

6. The handgun magazine of claim 5, wherein the two columns of cartridges in the double stack are offset from one another.

7. The handgun magazine of claim 1, wherein:

the handgun magazine is bisected by a median plane between the left tube sidewall and the right tube sidewall; and when the handgun magazine contains a plurality of cartridges, adjacent cartridges in the single-stack portion are vertically stacked along the median plane.

8. The handgun magazine of claim 7 wherein, when the handgun magazine is fully loaded, the double-stack portion includes exactly two offset columns of cartridges.

9. The handgun magazine of claim 7, wherein:

the vertical section is generally parallel to the median plane; and the first sloped section and the second sloped section each has a linear slope.

10. The handgun magazine of claim 7, further comprising rear lateral margins of the rear tube sidewall, the rear lateral margins having a linear taper from the double-stack portion substantially to the upper tube end, wherein when the handgun magazine is filled to capacity, the rear lateral margins dictate that heads of vertically adjacent cartridges within the single-stack portion are offset towards opposite sides of the median plane by varying amounts.

11. The handgun magazine of claim 9, wherein a width of the single stack portion from the vertical section of the left sidewall to the vertical section of the right sidewall is less than a width from the left tube sidewall to the right tube sidewall in the double stack portion.

12. A handgun magazine comprising:

a magazine tube having a front wall, a rear wall, a left wall, and a right wall;

wherein the right wall and the left wall define a single-stack portion and a double-stack portion positioned below the single-stack portion;

wherein, between an upper tube opening and the double-stack portion, part of the right wall and part of the left wall defining the single-stack portion include a stepped shape;

wherein the stepped shape includes a first sloped portion, a vertical section, and a second sloped portion;

wherein the first sloped portion extends downward and outward from the upper tube opening, the vertical section extends downward from the first sloped portion, and the second portion extends downward and outward from the vertical section; and wherein the stepped shape is configured to retain at least two cartridges in a single, descending column between the left wall and the right wall.

13. The handgun magazine of claim 12, wherein a width of the magazine tube from the vertical section of the left wall to the vertical section of the right wall in the single stack portion is less than a width from the left wall to the right wall in the double stack portion.

14. The handgun magazine of claim 12, wherein opposite lateral margins of the rear wall taper linearly from the double-stack portion to an upper tube end.

15. The handgun magazine of claim 12, wherein the vertical section and the second sloped portion each have a vertical height sufficient to accommodate one ammunition cartridge.

16. A handgun magazine comprising:

a magazine tube including a lower tube portion and an upper tube portion extending from the lower tube portion to an upper tube opening, the magazine tube having a left tube sidewall, a right tube sidewall, a rear wall and a front wall, wherein the lower tube portion is configured to retain a plurality of cartridges in two offset columns, wherein the upper tube portion is configured to retain a plurality of single stack cartridges in a single vertical stack with projectiles of the plurality of single stack cartridges generally aligned in a single column along the front wall;

the rear wall having lateral margins tapering linearly from a top of the lower portion to feed lips at the upper tube opening; and a forward portion of the left sidewall and a forward portion of the right tube sidewall including a first portion extending downward and outward from the upper tube opening, a second portion extending downward from the first portion, and a third portion extending downward and outward from the second portion to the top of the lower tube portion, wherein the second portion and the third portion each have a vertical height sufficient to accommodate one ammunition cartridge.

17. The handgun magazine of claim 16, wherein the magazine tube is bisected by a median plane between the left tube sidewall and the right tube sidewall, and when the handgun magazine is filled to capacity with cartridges, at least two cartridges within the upper tube portion are vertically stacked along the median plane.

18. The handgun magazine of claim 17, wherein, when the handgun magazine is filled to capacity, the lateral margins of the rear wall dictate that heads of vertically-adjacent cartridges within the upper tube portion are offset towards opposite sides of the upper tube portion by an amount that reduces moving towards the upper tube opening.

19. The handgun magazine of claim 17, wherein the upper tube portion has a capacity of at least three cartridges.

20. The handgun magazine of claim 16, wherein a width of the upper tube portion from the second section of the left tube sidewall and the second section of the right tube sidewall is less than a width from the left tube sidewall to the right tube sidewall in the lower tube portion.

* * * * *